United States Patent [19]

Kobayashi et al.

[11] Patent Number: 4,949,510

[45] Date of Patent: Aug. 21, 1990

[54] FULL-AUTOMATIC MULTI-FUNCTION BARREL FINISHING MACHINE

[75] Inventors: Hisamine Kobayashi; Katsuhiro Izuhara, both of Nagoya, Japan

[73] Assignee: Tipton Manufacturing Corporation, Nagoya, Japan

[21] Appl. No.: 279,103

[22] Filed: Dec. 2, 1988

[30] Foreign Application Priority Data

Dec. 28, 1987 [JP] Japan ..... 62-332150

[51] Int. Cl.[5] ..... B24B 31/037

[52] U.S. Cl. ..... 51/165.72; 51/164.2

[58] Field of Search ..... 51/165 TP, 165.71, 165.72, 51/163.1, 163.2, 164.2, 313; 241/171, 175, 176; 364/474.06

[56] References Cited

U.S. PATENT DOCUMENTS

| | | | |
|---|---|---|---|
| 3,233,372 | 2/1966 | Kobayashi | 51/313 |
| 3,698,138 | 10/1972 | Wada et al. | 51/165 TP X |
| 3,823,512 | 7/1974 | Kobayashi | 51/164.2 |
| 4,475,320 | 10/1984 | Webster | 51/165.72 X |
| 4,505,072 | 3/1985 | Kobayashi et al. | 51/164.2 |
| 4,638,600 | 1/1987 | Kobayashi et al. | 51/164.2 |
| 4,656,590 | 4/1987 | Ace | 364/474.06 |
| 4,776,135 | 10/1988 | Tham, III et al. | 51/164.2 |

FOREIGN PATENT DOCUMENTS 54-5874 3/1979 Japan .

*Primary Examiner*—Robert P. Olszewski

*Attorney, Agent, or Firm*—Wenderoth, Lind & Ponack

[57] ABSTRACT

A full-automatic multi-function workpiece finishing machine provides different types of operations that can be caused to occur in any sequence that meets the requirements for a particular type of workpieces to be surface-finished. The machine includes a series of individual operational or functional units which are controlled by a computer-based sequence controller. The sequences of the different types of operations may be identified by unique code numbers which are entered into the computer from the terminal keyboard or by reading them by any optical or other means.

4 Claims, 30 Drawing Sheets

Initial Menu (a)

FIG.31

(g)

Removal Mode

| Code No. | Individual Operation | Black Key | Red Key |
|---|---|---|---|
| 1 | Index (lid position) | | |
| 2 | Index (lid position) | | |
| 3 | Turret nock (lid positipn) | Out | In |
| 4 | Index (place/remove position) | Remove | Place |
| 5 | Barrel positioning | | |
| 6 | Turret nock (place/remove pos.) | Remove | Place |
| 7 | "A" manipulator | Up | Down |
| 8 | Barrel nock | Remove | Place |
| 9 | "A" lid clamp | Open | Close |
| 10 | "B" manipulator | Up | Down |
| 11 | "A" nut runner | Tighten | Untighten |
| 12 | "B" lid clamp | Open | Close |
| 13 | "A" clamp arm | Return | Turn |
| 14 | "B" nut runner | Tighten | Untighten |
| 15 | "A" lid shower | Backward | Forward |
| 16 | "B" clamp arm | Return | Turn |
| 17 | "A" lid shower | | |
| 18 | "B" lid shower | Backward | Forward |
| 19 | "A" mass separator | Up | Down |
| 20 | "B" lid shower | | |
| 21 | "A" mass separator | Run | Stop |
| 22 | "B" mass separator | Up | Down |
| 23 | "A" mass separator shower | Run | Stop |
| 24 | "B" mass separator | Run | Stop |
| 25 | "A" mass separator air blower | Run | Stop |
| 26 | "B" mass separator shower | Run | Stop |
| 27 | "A" external barrel shower | Run | Stop |
| 28 | "B" mass separator air blower | Run | Stop |
| 29 | "A" internal barrel shower | Forward | Backward |
| 30 | "B" external barrel shower | Run | Stop |
| 31 | "A" internal barrel shower | Run | Stop |
| 32 | "B" internal barrel shower | Forward | Backward |
| 33 | "A" drain valve | Open | Close |
| 34 | "B" drain valve | Open | Close |
| 35 | "A" move media bucket to VS pos. | | |
| 36 | "B" move media bucket to VS pos. | | |
| 37 | Rotate turret (r. p. m) | | |
| 38 | Rotate burrel (r. p. m) | | |

FIG.31
(h)

Place Mode

| Code No. | Individual Operation | Black Key | Red Key |
|---|---|---|---|
| 51 | Index (lid position) | | |
| 52 | Index (place/remove pos.) | | |
| 53 | Turret nock (lid position) | Out | In |
| 54 | Turret nock (place/remove pos.) | Out | In |
| 55 | Barrel positioning | | |
| 56 | Barrel nock | Out | In |
| 57 | "A" manipulator | Up | Down |
| 58 | "B" manipulator | Up | Down |
| 59 | "A" lid clamp | Open | Close |
| 60 | "B" lid clamp | Open | Close |
| 61 | "A" nut runner | Tighten | Untighten |
| 62 | "B" nut runner | Tighten | Untighten |
| 63 | "A" clamp arm | Return | Turn |
| 64 | "B" clamp arm | Return | Turn |
| 65 | "A" place workpieces | Run | Stop |
| 66 | "B" place workpieces | Run | Stop |
| 67 | "A" move media bucket to "UP" pos. | Run | Stop |
| 68 | "B" move media bucket to "UP" pos. | Run | Stop |
| 69 | "A" move media bucket to VS pos. | Run | Stop |
| 70 | "B" move media bucket to VS pos. | Run | Stop |
| 71 | "A" media bucket | Up | Down |
| 72 | "B" media bucket | Up | Down |
| 73 | "A" media bucket | Return | Turn |
| 74 | "B" media bucket | Return | Turn |
| 75 | "A" media bucket clamp | Open | Close |
| 76 | "B" media bucket clamp | Open | Close |
| 77 | "A" water supply | | |
| 78 | "B" water supply | | |
| 79 | "A" compound No. 1 | | |
| 80 | "B" compound No. 1 | | |
| 81 | "A" compound No. 2 | | |
| 82 | "B" compound No. 2 | | |
| 83 | "A" compound No. 3 | | |
| 84 | "B" compound No. 3 | | |
| 85 | Rotate turret (r. p. m) | | |
| 86 | Rotate barrel (r. p. m) | | |

FIG.31 (i)

Media Change Mode

| Code No. | Individual Operation | Black Key | Red Key |
|---|---|---|---|
| 101 | "A" move media bucket to "UP" pos. | | |
| 102 | "B" move media bucket to "UP" pos. | | |
| 103 | "A" move media bucket to VS pos. | | |
| 104 | "B" move media bucket to VS pos. | | |
| 105 | "A" move media bucket to hopper | | |
| 106 | "B" move media bucket to hopper | | |
| 107 | "A" media inlet | Backward | Forward |
| 108 | "B" media inlet | Backward | Forward |
| 109 | Vacuum unit | Run | Stop |
| 110 | Tank lid | Close | Open |
| 111 | Move feed hopper (No.) | | |
| 112 | Feed hopper lid | Close | Open |
| 113 | Move weighing hopper (No.) | | |
| 114 | Weighing hopper lid | Close | Open |
| 115 | Media hopper lid (No.) | Open | Close |

FULL-AUTOMATIC MULTI-FUNCTION BARREL FINISHING MACHINE

BACKGROUND OF THE INVENTION

1. Field of the Invention

The present invention relates generally to the art of surface-finishing for various types of workpieces, and more particularly to a full-automatic multi-function barrel finishing machine comprising a plurality of barrels rotatably supported by their respective shafts which are perpendicular to a turret shaft for driving the barrel shafts for the orbital rotation about it. The functions provided by the machine include surface-finishing or polishing, milling, deburring, and the like of workpieces.

More specifically, the present invention relates to a barrel finishing machine that includes a turret rotatably supported by its shaft and a plurality of barrels rotatably supported by their respective shafts mounted on the turret perpendicularly to the turret shaft, for causing both the axial and orbital rotations of the barrels, thereby subjecting workpieces within those barrels to the surface-finishing actions such as polishing, milling, deburring and the like by interacting with abrasive media and any chemical compounds which are also contained in the barrels, wherein the improvement comprises a single machine construction that provides the multiple functions such as the rotating barrel finishing, centrifugal-flow barrel finishing, rotating barrel finishing under heavy resultant force (this will be called "heaving rotating barrel finishing") and rotating barrel finishing under centrifugal force. Those different types of operations may be selected depending upon the particular workpiece finishing requirements, and this selection may be made by varying certain parameters, such as the number of rotations of the turret and/or the number of rotations of the barrels, which have previously been defined and stored in any appropriate sequence controller means. This eliminates the need of having several units in the machine configuration which correspond to the different types of operations. In addition, any suitable computer such as a microcomputer may control the associated machine operations such as the selection and delivery of abrasive media into the individual barrels, the running of the machine for the workpiece finishing purposes, and the separation of the finished workpieces and the abrasive media used together with the workpieces.

2. Description of the Prior Art

In the prior art, there is a barrel finishing machine including a turret shaft and individual barrel shafts mounted perpendicularly to the turret shaft, which is designed for the individual types of finishing such as rotating, heavy-rotary, and the centrifugal-flow. However, rotating type under centrifugal force is not included, and no automatic operation is provided.

It is therefore necessary to provide certain parameters such as the speed of rotation for the turret and the speeds of rotations for the barrels, and to allow those parameters to be varied individually or in combination to meet the particular needs. A motor connected to each of the corresponding turret shaft and individual barrel shafts, and a frequency inverter is provided for each motor to cause the associated motors to provide the varying speeds of rotations. Those frequency inverters are controlled by the computer that provides the control signals.

It is also necessary to provide certain associated component units for functions such as abrasive media storage, feeder and return, barrel-lid close/open, and cleaner, compound feeder, barrel water removal, vacuum transfer of the media, barrel shaft positioning, mass separator, bucket transfer, and workpieces and abrasive media charging. Those component units must have operational and functional relationships, and must operate in well-organized relationships under control of any proper computer.

SUMMARY OF THE INVENTION

One principal object of the present invention is to solve the above-described problems by making all the necessary functions automatic and well-organized through the use of any suitable computer that may provide the respective control functions that correspond to each type of operation.

In its specific form, the machine construction according to the present invention includes a turret rotatably supported by a turret shaft and a plurality of barrels mounted on the turret and rotatably supported by their respective shafts mounted perpendicularly to the turret shaft, the turret shaft and each of the barrel shafts carrying means for causing each respective shaft to rotate. The means for rotating the turret shaft is designed to provide any number of rotations per minute, according to its finishing mode as explained afterward. Each of the barrel shafts may rotate with the same speed as the turret shaft, or may rotate with a speed different from the turret shaft. Each of the above means has its input connected through the computer to any suitable sequence controller. The sequence controller is also controlled by the computer. The different types of operations are identified by the corresponding code numbers which are previously defined and stored in the computer. Those code numbers may be entered on any suitable keyboard or by using any suitable mark reader which reads the mark representing the code number that may be carried by a bucket to contain workpieces and abrasive media (which are collectively referred to as "mass"). Any code number entered in the above manner is then compared by the computer with the corresponding code number stored in the computer, and the operation sequence and conditions defined by the matching code number are selected. Thus, the appropriate operation can proceed according to the selected sequence and conditions.

The means for rotating the barrels, for example, is described and includes a sleeve provided coaxially with respect to the turret and pivotable outwardly with respect to the same, the sleeve having a first bevel gear at one end thereof, the first bevel gear being in mesh with a second bevel gear rotatably supported on the turret. The opposite end of the shaft supporting the second bevel gear carries a pulley which is connected with a pulley on the barrel shaft through any suitable power transmission means.

Another form of the present invention includes other component units in addition to those described for the preceding form of the present invention. The machine construction according to this form comprises a turret rotatably supported by its shaft and a plurality of barrels mounted on the turret and rotatably supported by their respective shafts which are mounted perpendicularly to the turret shaft, the turret shaft and each of the barrel shafts carrying means for causing each respective shaft to rotate. The means for rotating the turret shaft is designed to provide any number of rotations per minute, according to the finishing mode. Each of the barrel shafts may rotate with the same speed as the turret shaft, or may rotate with a speed different from the turret shaft. In addition to those basic and other component units which are substantially similar to those for the preceding embodiment, it further includes means for manipulating the lids for the barrels when the barrels containing the workpieces that have been finished are to be opened, a mass separator, means for determining each charge of different types and sizes of abrasive media to be added, and means for delivering those abrasive media into the barrels. Each of those component units is controlled by any suitable sequence controller which is in turn controlled by a central computer. The different types of operations are identified by corresponding code numbers which are previously defined and stored in the computer. Those code numbers may be entered on any suitable keyboard or by using any suitable mark reader which reads the mark representing the code number that may be carried by a bucket to contain workpieces and abrasive media (which are collectively referred to as "mass"). Any code number entered in the above manner is then compared by the computer with the corresponding code number stored in the computer, and the operation sequence and conditions defined by the matching code number are selected. Thus, the appropriate operation can proceed according to the selected sequence and conditions.

BRIEF DESCRIPTION OF THE DRAWINGS

These and other objects, features, and merits of the present invention will become apparent from the detailed description of several preferred embodiments that follows with reference to the accompanying drawings, in which:

FIG. 6*a* is a schematic diagram illustrating the principle of operation for rotating barrel finishing under heavy resultant force and that under centrifugal force;

FIG. 6*b* is a schematic diagram illustrating how the force is applied against the mass when the turret and barrel shafts have the horizontal relationship in the centrifugal barrel finishing machine;

FIGS. 31(*c*) and (*d*) show the various screens which will be displayed when the appropriate items are selected from the intial menu screen.

DESCRIPTION OF THE PREFERRED EMBODIMENTS

Figure 1:
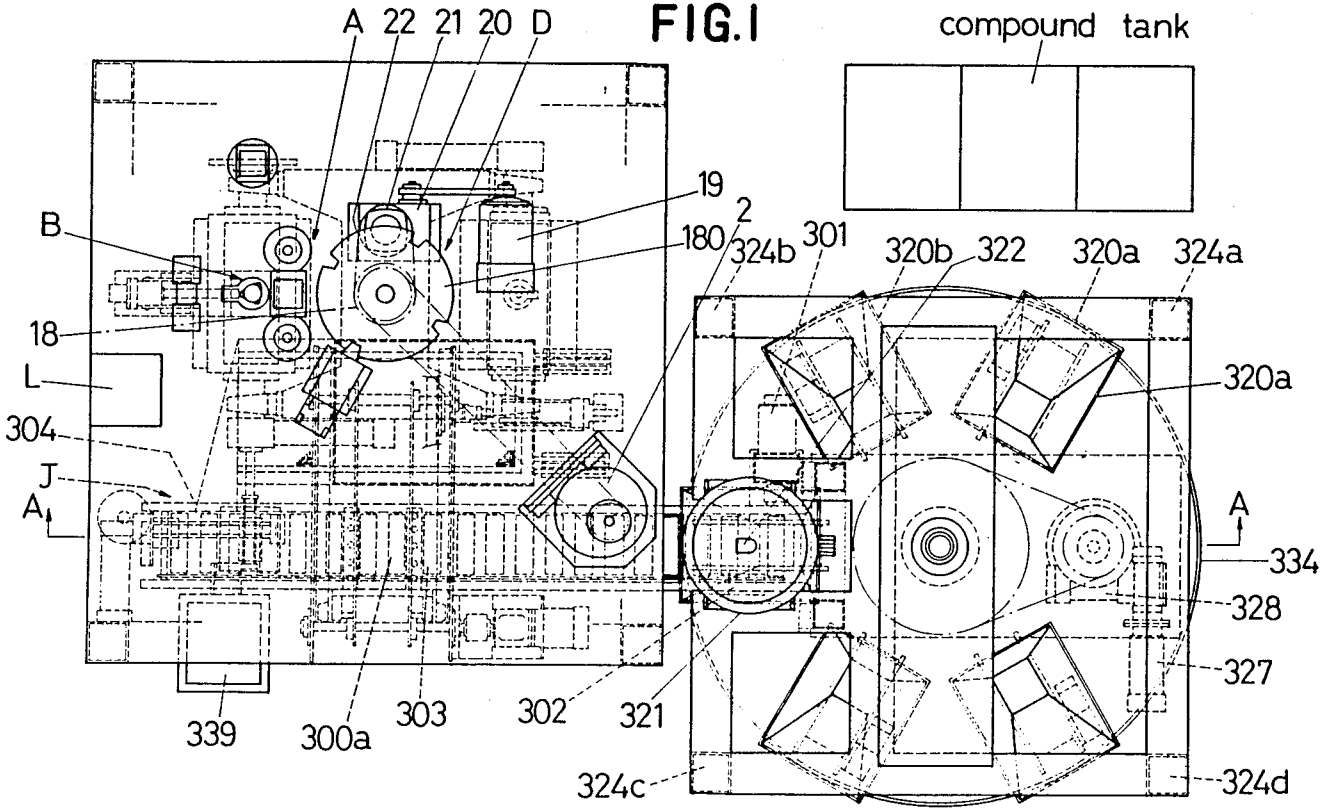
FIG. 1 is a plan view of the machine according to the present invention.
Figure 2:
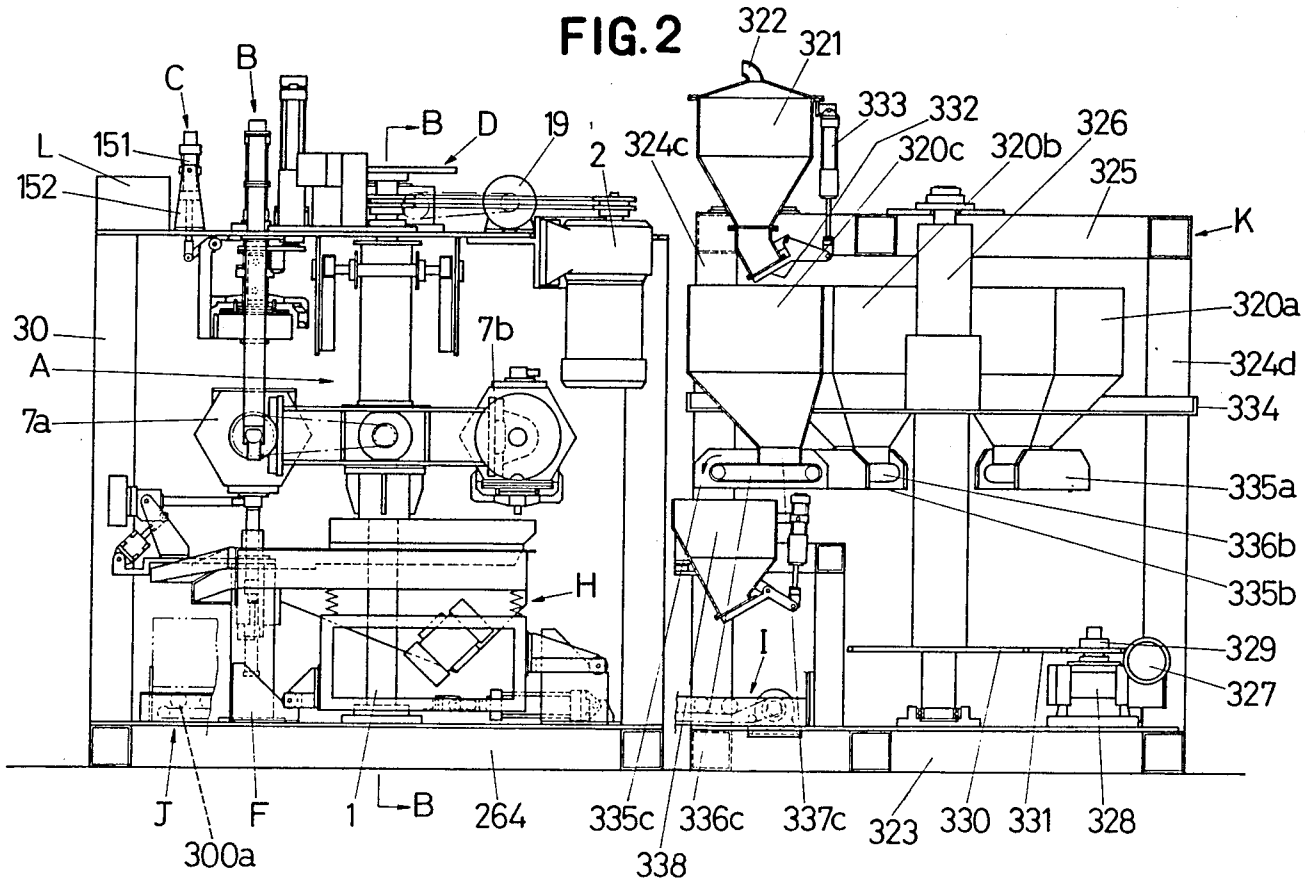
FIG. 2 is a front view of the machine in FIG. 1.
Figure 3:
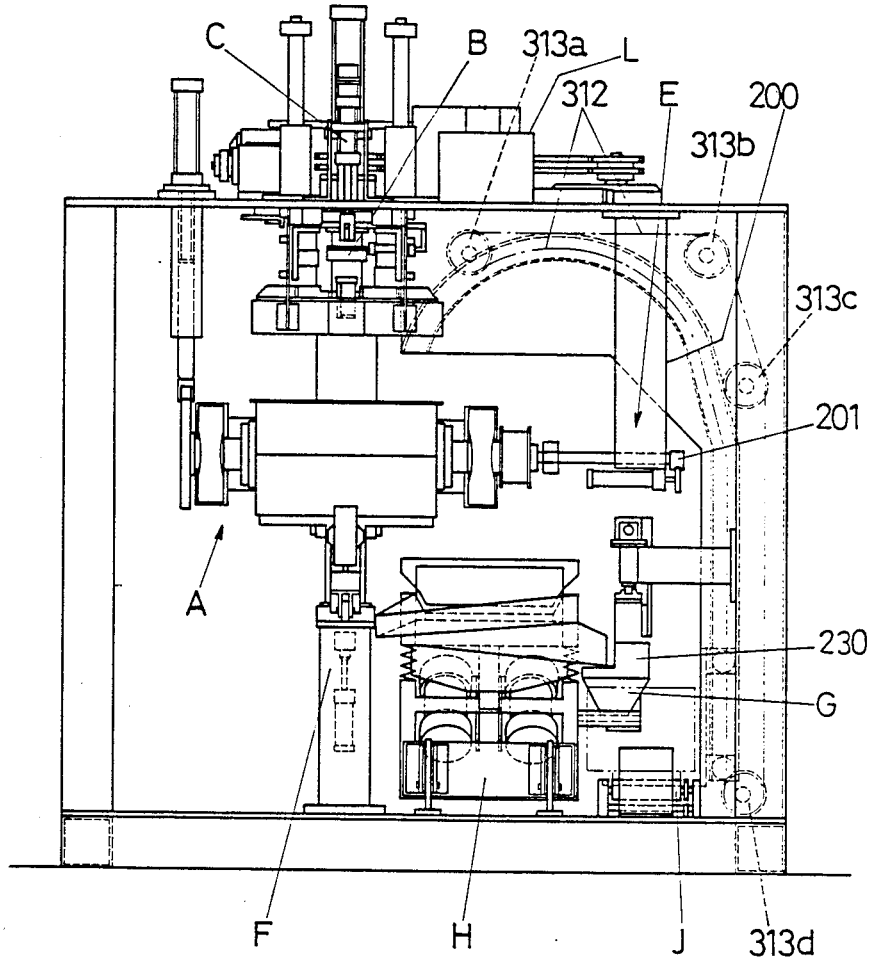
FIG. 3 is a partial side view of the machine in FIG. 1.

In FIGS. 1, 2 and 3, there is shown the typical machine configuration according to the present invention, including a workpiece finishing unit A in the form of a barrel, a barrel-lid closing/opening unit B, a barrel-lid cleaning unit C, a barrel main spindle positioning unit D, a compound supply unit E, a water drain unit F, a vacuum transfer unit G, a mass separator unit H, a bucket conveyor unit I with a bucket turn-over unit J, an abrasive media supply unit K, and a microprocessor-based control unit L.

Figure 5:
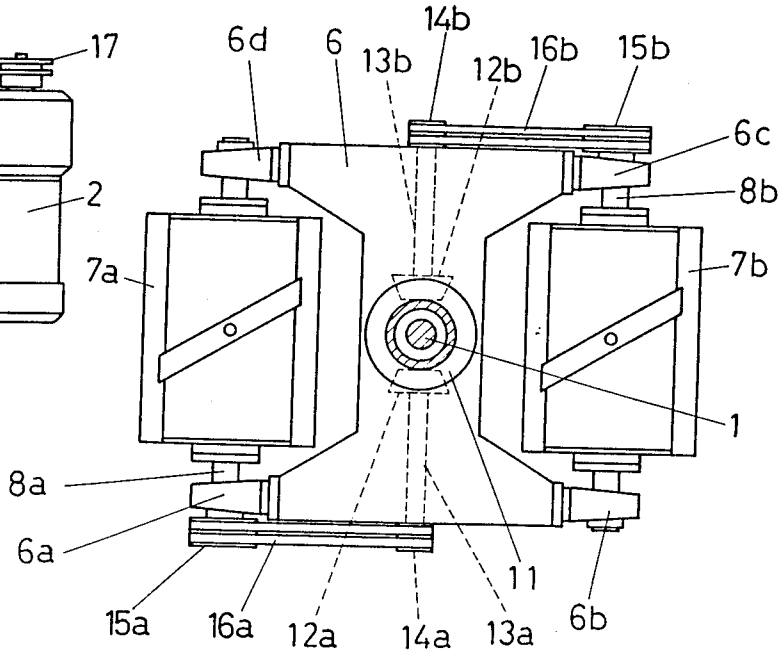
FIG. 5 is a plan view of the embodiment in FIG. 4.
Figure 4:
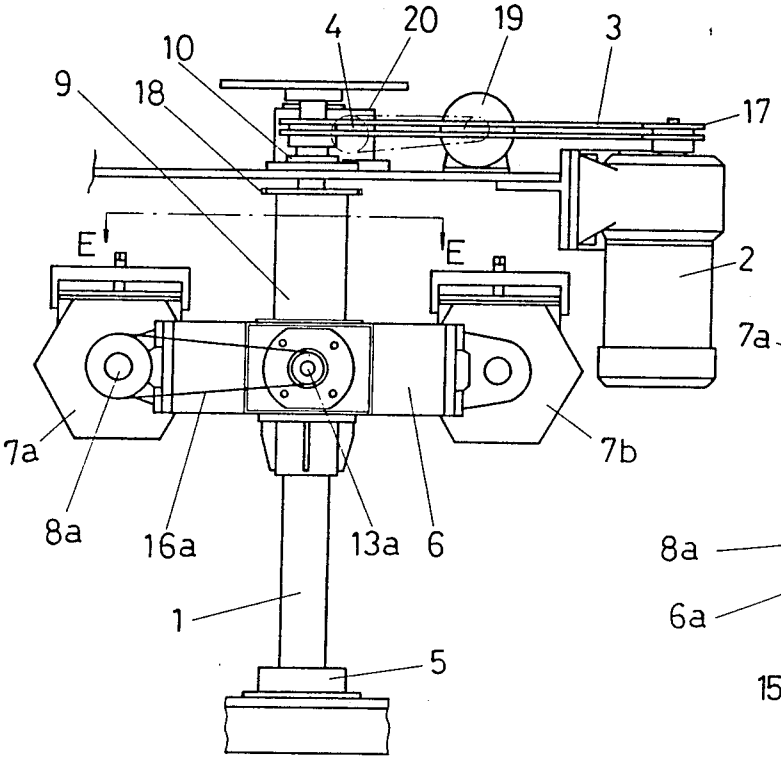
FIG. 4 illustrates a typical embodiment of the present invention that includes a plurality of barrels rotating about their respective shafts as well as about a turret shaft.

First, the workpiece finishing unit A, which is the principal mechanical part of the machine configuration is described. This part A includes a high-speed turret 6 rotatably supported by its shaft or main spindle 1, and a plurality of barrels such as 7*a*, 7*b* rotatably supported by their respective shafts such as 8*a*, 8*b*, the barrel shafts 8*a*, 8*b* and the turret spindle 1 having the positional relationships such that the former are placed perpendicularly to the latter. Each barrel, generally designated by 7, can rotate at a number of revolutions per minute that satisfies the relationship $n/N=1$ in relation to the turret. Each barrel can also rotate individually with a different number of revolutions per minute Details of the workpiece finishing unit A are shown in FIGS. 4 and 5. As shown, the main spindle 1 and individual barrel shafts 8*a*, 8*b* are arranged perpendicularly. Each of the barrels 7*a*, 7*b* has a hexagonal or octagonal shape with its generating line parallel with the barrel shafts 8*a*, 8*b*.

The workpiece finishing unit A is housed within a frame 30, across which the main spindle 1 extends vertically. A main motor 2 has a shaft which carries a sprocket wheel 17 which is linked with the corresponding sprocket wheel 4 on the main spindle 1 by means of a chain 3. Thus, the drive power from the main motor 2 can be transmitted to the main spindle 1. The speed of the main spindle 1 may be controlled by any suitable known frequency inverter that can provide varying frequencies. The main spindle 1 is journalled in a bearing 5 at its bottom end, and is journalled in a bearing 10 at its top end. These bearings 5 and 10 are mounted on lower and upper frame members, respectively. The main spindle 1 supports the earlier-mentioned turret 6 which is rigidly mounted around the intermediate portion of the main spindle 1 and is horizontal with regard to the vertical main spindle. The turret 6 has an H-shape in plan view having four arms 6a, 6b, 6c, 6d extending outwardly as shown in FIG. 5. On one side of the H-shaped turret 6, the barrel shaft 8a is mounted rotatably between the arms 6a and 6d, and on the other side, the barret shaft 8b is mounted rotatably between the arms 6b and 6c. In FIGS. 4 and 5, two barrels 7a and 7b are provided, but three or four barrels may be provided.

The main spindle 1 carries a sleeve 9 as shown in FIG. 4, which is mounted rotatably around the main spindle, the sleeve 9 having a bevel gear 11 at the bottom end thereof and having a sprocket wheel 18 at the top end thereof. The sprocket wheel 18 is driven by its own motor 19. The driving power from the motor 19 is transmitted to the sprocket wheel 18 through a reduction gear 20, a sprocket wheel 21 and a chain as shown in FIG. 1. The bevel gear 11 meshes with bevel gears 12a and 12b whose respective shafts 13a and 13b are rotatably mounted on the turret 6. The shafts 13a and 13b extend beyond the turret 6, each shaft carrying a pulley 14a, 14b at its free end. Each of the barrel shafts 8a and 8b also carries a pulley 15a, 15b which is linked with the corresponding pulley 14a or 14b by means of a V-type belt 16a, 16b. The bevel gear 11 and bevel gear 12a or 12b may have specific gear ratio. That is, n/N=(diameter of the pulley 15)×(the number of teeth of the gear 12)/{(the number of teeth for the gear 11)×(the diameter of the pulley 14)}. The gear ratio and diameter ratio determine the number of revolutions of the barrel with regard to the turret as expressed by n/N, where n and N are the given numbers of revolutions for the barrel and turret, respectively.

In the example shown and described, the gear ratio is equal to ½, and the diameter ratio is equal to 2, which means n/N=1. When n/N=1, it will be understood that the barrel will rotate through one turn for one complete revolution of the turret, and then will be positioned in the same orientation as it was before the turret began to revolve.

It may also be appreciated that when n/N is equal to any integer, the barrel is always placed in the same orientation as it was before the operation began, when the turret has completed its specific number of revolutions and stopped at its designated position. In the example shown in FIG. 4, the barrel will have been placed with its lid directed upwardly, after the operation is completed. This is particularly useful when the mass or a mixture of workpieces and abrasive media is to be delivered into the barrel, and the delivery may be automatic.

As described, the main motor 2 and barrel drive motor 19 are provided, and the power supply for each of the motors is connected to a frequency inverter which is per se known. These frequency inverters supply varying frequencies which control the numbers of revolutions per minute for the respective motors. The frequency inverters may be controlled manually or automatically under control of any suitable computer or microprocessor-based sequence controller. Both motors 2 and 19 may be driven simultaneously, and may be controlled by the respective frequency inverters so that the motors provide the numbers of revolutions as well as the sense of rotation as selected appropriately. Thus, a value of n/N may be obtained depending upon the selected number of revolutions and the sense of rotation.

Each barrel 17a, 17b may contain an amount of mass that is substantially equal to half its total capacity, and the main spindle 1 may be rotated with the number of revolutions per minute that is substantially equal to less than $N=42.2/\sqrt{D}$. The resultant force which is substantially equal to $1G<Y<\sqrt{2G}$ (where Y is the resultant force) is produced and acts against the mass. This type of operation provides the rotating barrel operation under a heavy resultant force, whereby a flow layer will be produced on the mass surface. This operation is particularly useful in the high-precision finishing process at a high speed. The turret 6 may be rotated at a higher speed by fixing the sleeve 9 nonrotationally. This type of operation corresponds to the centrifugal flow barrel operation whereby the turret may be rotated at a number of revolutions per minute equal to more than $N=42.2/\sqrt{D}$, and the barrel may be rotated with its own number of revolutions, that is, n/N=1. The rotating barrel operation may occur under the action of the produced centrifugal force, which type of operation may be referred to as the centrifugal flow barrel operation.

It is possible that the sleeve 9 can be released so that it can rotate while the turret 6 is fixed. In this case, the barrel shafts 8a, 8b are driven for rotation, causing the corresponding barrels 7a, 7b to rotate only around the axes of these shafts. This provides the rotating barrel-type operation.

Those types of operations that have been described above, such as the centrifugal flow barrel operation, rotating barrel operation under centrifugal force, rotating barrel operation, and heavy rotating barrel operation, can be provided by only a single machine. For this purpose, a sequential control may be provided by any suitable computer or microprocessor-based controller that can cause any particular type of operation to be selected and to proceed from one type to another. Each type of operation consists of several steps which may be performed by the computer or microprocessor-based controller. In addition, the requirements for each type of operation have been defined, such as the numbers of revolutions for the turret and barrels, and when any particular type of operation is to occur, it may be done according to its own requirements.

Table 1 summarizes the parameters for each type of operation.

TABLE 1

| r.p.m. for turret(N) | r.p.m. for barrel | type of operation |
|---|---|---|
| 0 | less than $42.2/\sqrt{d}$ | rotating barrel |
| $N < 42.2/\sqrt{D}$ | less than $59.7/\sqrt{d}$ | heavy-rotating barrel |
| $N \geqq 42.2/\sqrt{D}$ | $n/N = 1$ | centrifugal flow barrel |
| $N \geqq 42.2/\sqrt{D}$ | $n/N \neq 1$ | rotating barrel under centrifugal force |

rotating barrel operation and $59.7/\sqrt{d}$ in heavy-rotating barrel operation, the mass is stuck to the periphery of the barrel wall by centrifugal force, and no finishing is performed.

For example, when the centrifugal force (C) that is produced by the rotating turret is n times gravity (G), the resultant force of both forces will increase up to $F=\sqrt{1+n^2}G$ as shown in FIG. 6a. The range within which the number of rotations is available during the rotating barrel operation can thus be increased. Thus the high-speed rotating barrel operation can be achieved within that range, which is novel to the rotating barrel finishing technology. This may conveniently be referred to as the rotating barrel operation under centrifugal force ($N \geqq 42.2/\sqrt{D}$). For $n/n=1$, however, it should be noted that this type of operation can be done by a machine that has been designed and manufactured as a centrifugal flow barrel machine. But the centrifugal flow barrel functions provided by the present invention are essentially different from the corresponding conventional centrifugal flow barrel machines. For example, for the conventional centrifugal flow barrel machine having its barrels supported by the respective horizontal shafts, when a given barrel is placed above the turret as shown in FIG. 6b, the force upon the mass within the barrel is substantially equal to the produced centrifugal force minus the gravity, and when the barrel is placed below the turret, the force upon the mass is substantially equal to the produced centrifugal force plus the gravity. In contrast, the centrifugal flow barrel operation according to the present invention always produces equal resultant forces of the centrifugal force and gravity at every position of the barrel. For the conventional centrifugal flow barrel machine having its barrels supported by the respective vertical shafts, the mass within the barrel is rising when the machine is started up, and it is falling when the machine is stopped. According to the present invention, this cannot happen. In all cases, better finished surfaces can be provided. The following tables (Table 2 and Table 3) summarize the testing results for all types of operations according to the present invention and the conventional types.

The heavy rotating barrel and centrifugal flow barrel used for the testing purposes each have the hexagonal form having the opposed side length of 317.4 mm and the longitudinal length of 520 mm. The abrasive media used is AT-4 including the compound GCP (120 g. offered by Tipton Co.). The running time is one hour. The workpieces used as speciments for the testing purposes include SUS and standard bronze test pieces.

TABLE 2

| type of barrel | axial (rpm) | orbital (rpm) | centrifugal force |
|---|---|---|---|
| rotating | 44 | — | — |
| heavy rotating | 44 | 44 | 1 G |
| centri-flow | 117 | 117 | 7 G |
| *centrifugal HS-R80 | 147 | 147 | 7.85 G |

TABLE 3

| type of barrel | wear amt g | wear rate % | amt of finish (mg) SUS | amt of finish (mg) bronze | roughness (μm) SUS | roughness (μm) bronze |
|---|---|---|---|---|---|---|
| rotating | 102 | 0.302 | 8.2 | 31.8 | 3.50 | 5.40 |
| heavy rotating | 302 | 0.907 | 25.9 | 99.4 | 4.20 | 5.25 |
| centri-flow | 3044 | 9.22 | 377.9 | 1489 | 6.05 | 9.20 |

TABLE 3-continued

| type of barrel | wear amt g | wear rate % | amt of finish (mg) SUS | amt of finish (mg) bronze | roughness (μm) SUS | roughness (μm) bronze |
|---|---|---|---|---|---|---|
| HS-R80 | 1640 | 9.6 | 257.4 | 1128.7 | 6.0 | 9.0 |

Remarks: SUS is stainless steels in Japanese Industry Standard.

It may be seen from Table 3 that the heavy-rotating barrel provides a finishing capability which is substantially equal to three times that of the rotary barrel, with the resulting surface finishes being almost equal for both the barrels. The centrifugal flow barrel according to the present invention provides a finishing capability which has been enhanced by 30% to 50% as compared with the usual centrifugal-flow barrel, with its resulting surface roughness remaining the same. The testing results show that the machine according to the present invention provides advantages over the conventional corresponding machines. As can be understood from the foregoing description, the machine according to the present invention provides multiple functions including the rotating barrel, centrifugal flow barrel, heavy rotating barrel, and rotating barrel under centrifugal force. These different barrel functions may be provided singly or in any combination, and may be performed in any sequence by any appropriate computer.

Figure 7:
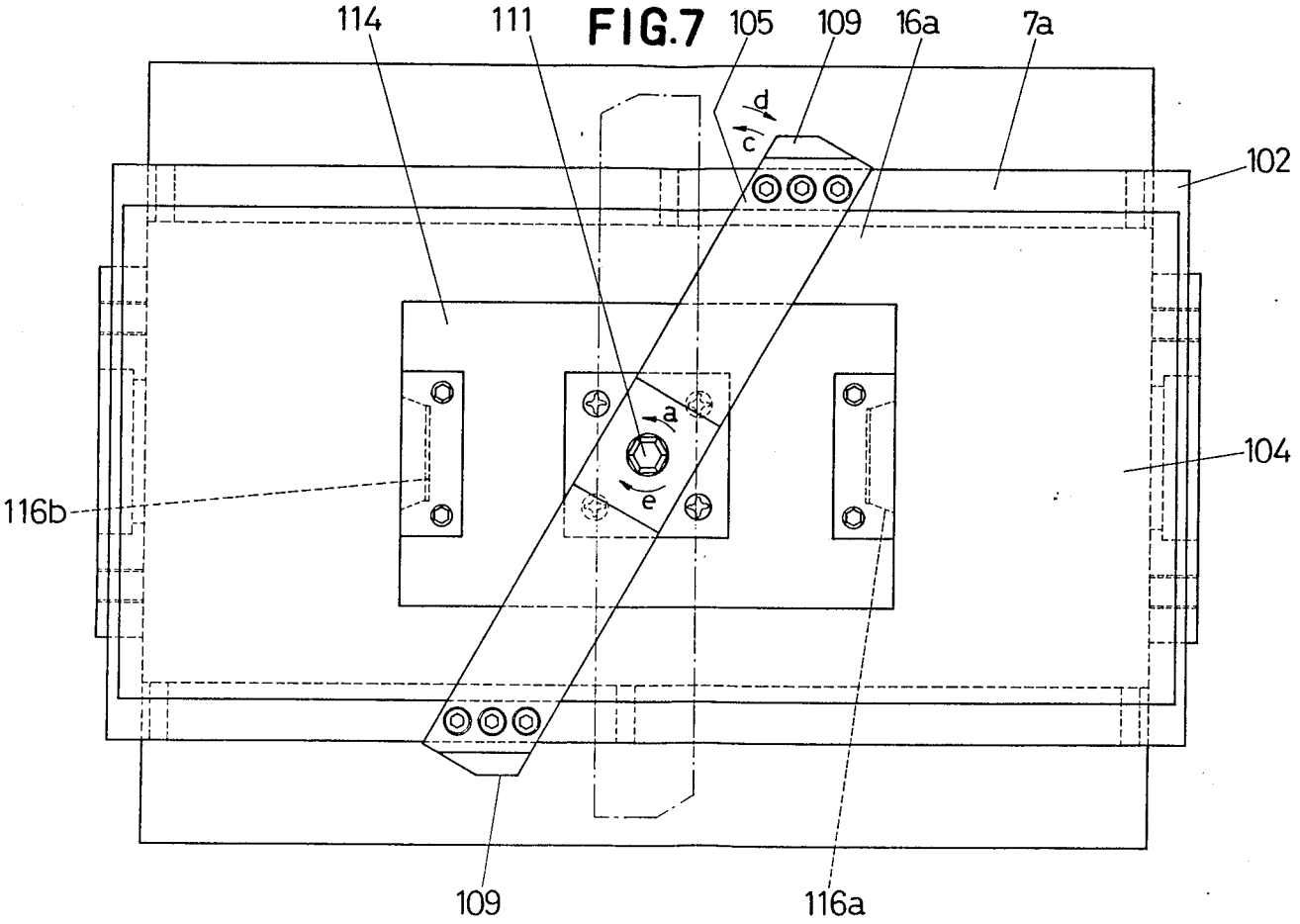
FIG. 7 is a plan view illustrating the barrel-lid closing/opening unit.
Figure 8:
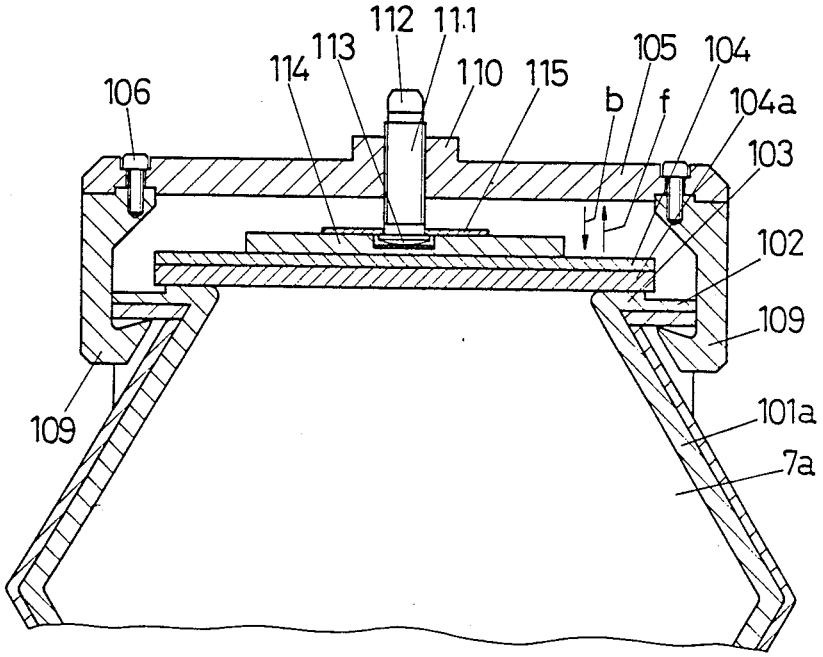
FIG. 8 is a cross section across the center of the barrel-lid closing/opening unit in FIG. 7.

Referring next to FIGS. 7 and 8, the lid construction and its opening/closing mechanism for the individual barrels are shown. These are described in detail in the Utility Model Application which is open under No. 60-175995 of Japan. All parts or elements associated with the lid construction are given by adding 100 to the number of above specification.

Referring to FIG. 8, there is a barrel construction shown as 7a for example. The barrel has a rubber or other synthetic resin lining 101a which covers the internal wall of the barrel, and is open at the top 103 whose marginal edge has a flange 102 extending outwardly. A lid 104 which is also internally lined with a rubber or other synthetic resin packing 104a is releasably mounted on the barrel. When it is mounted, the lid keeps the barrel sealed by tightening it to the barrel. The lid 104 has a tightening rod 105 across it, and has a hooked pawl 109 extending downwardly from each of the opposite ends thereof. The hooked pawl 109 is secured to the tightening rod 105 by means of a bolt 106. The tightening rod 105 has a hole 110 at the center which is internally threaded for accepting a bolt 111 having a hexagonal head 112 and a bottom end 113. The bottom end 113 is formed so that it can engage a hole 115 on a rest plate 114 rigidly secured to the lid 104, thus preventing the bolt 111 from escaping from the center hole 110 on the tightening rod 105. In FIG. 7, reference numeral 116a or 116b designates a rectangular portion extending from the lid 104 on either side, which can be engaged by a manipulating pawl.

Referring then to FIGS. 7 and 8, the lid may be released from its barrel in the following steps:

(1) Rotate the bolt 111 in the direction of arrow a in FIG. 7 (counterclockwise). This may be accomplished manually or by using any suitable power driving device. Then, the tightening rod 105 will advance in the direction of arrow b in FIG. 8. This will disengage the pawls 109 of the tightening rod from the flange 102 of the barrel;

(2) Turn the tightening rod 105 in the direction of arrow c in FIG. 7. This may be accomplished manually or by any suitable power driving device. Then, stop it when it comes flush with the edges of the lid 104. This allows the tightening rod 105 and its pawls 109 to be moved away from the flange 102 of the barrel, freeing the barrel from the tightening rod completely; and (3) Engage manipulating pawls with the projecting portions 116*a*, 116*b*. This allows the lid to be removed from the barrel, and the releasing operation is now concluded.

The lid may be mounted on its barrel by carrying out the above steps in the reverse sequence. That is, the lid 104 is placed on the barrel 7*a* to cover the opening 103, and the tightening rod 105 is then turned in the direction of arrow d in FIG. 7. This action engages the pawls 109 of the tightening rod 105 with the flange 102 of the barrel 7*a*. Then, the bolt 111 is turned in the direction of arrow e (clockwise) in FIG. 7. This action moves the tightening rod 105 toward the barrel in the direction of arrow f in FIG. 8. Thus, the lid 104 is forced against the flange 102 of the barrel 7*a*, and the barrel is completely closed.

Figure 9:
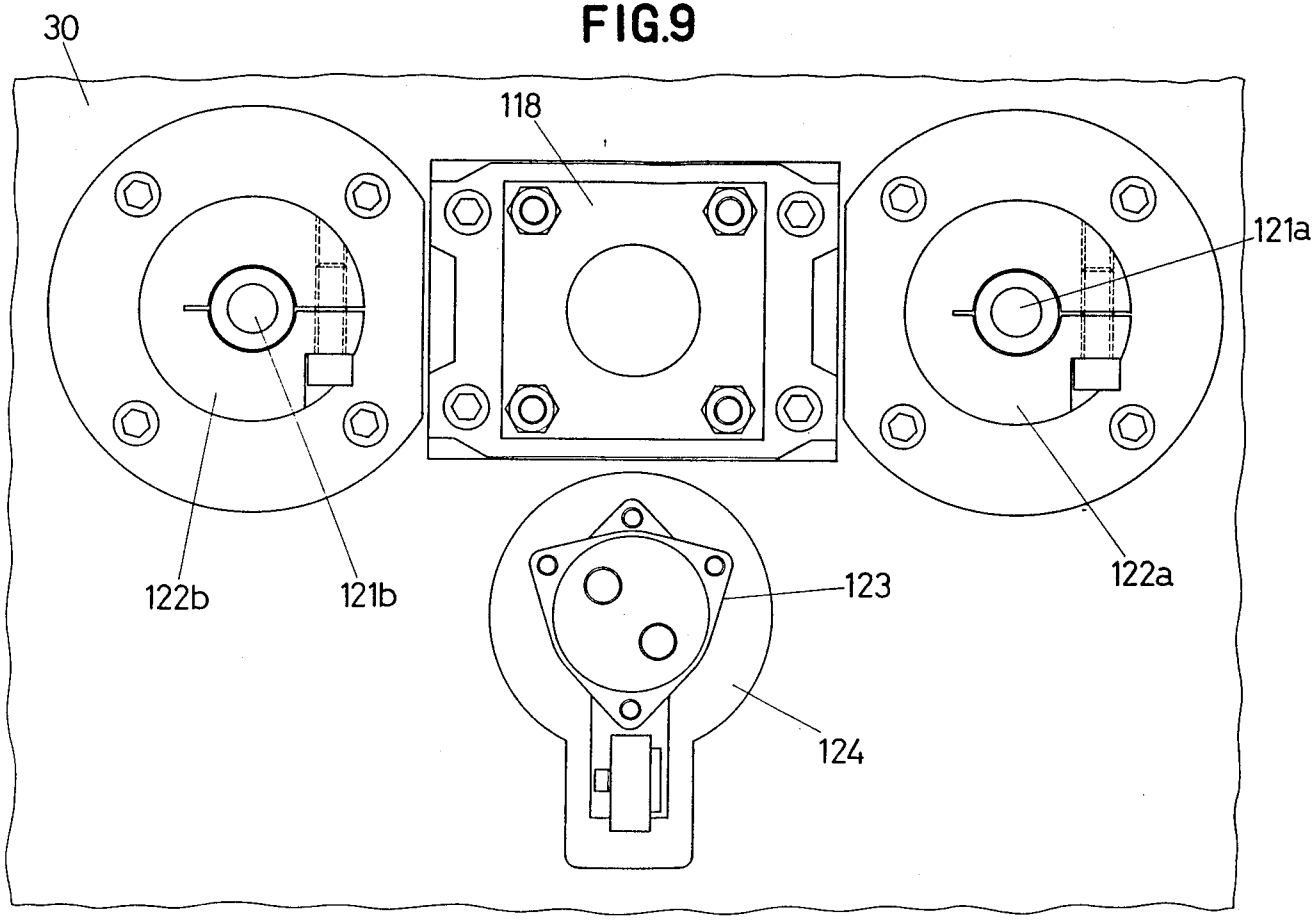
FIG. 9 is a top plan view illustrating the barrel-lid closing/opening and lifting unit.
Figure 10:
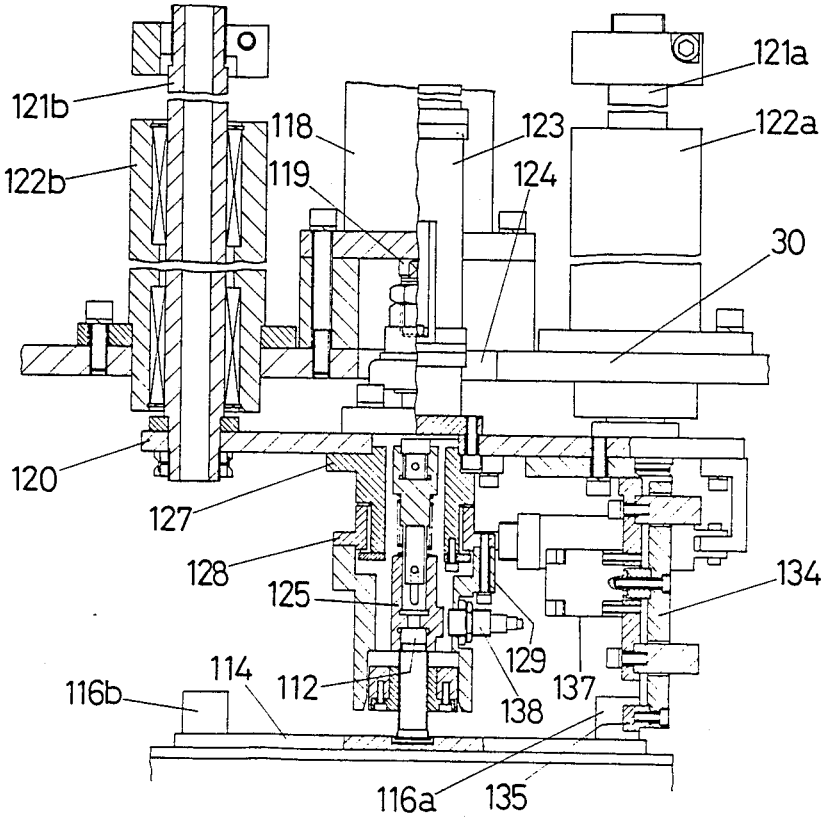
FIG. 10 is a front partly sectional view of FIG. 9.
Figure 11:
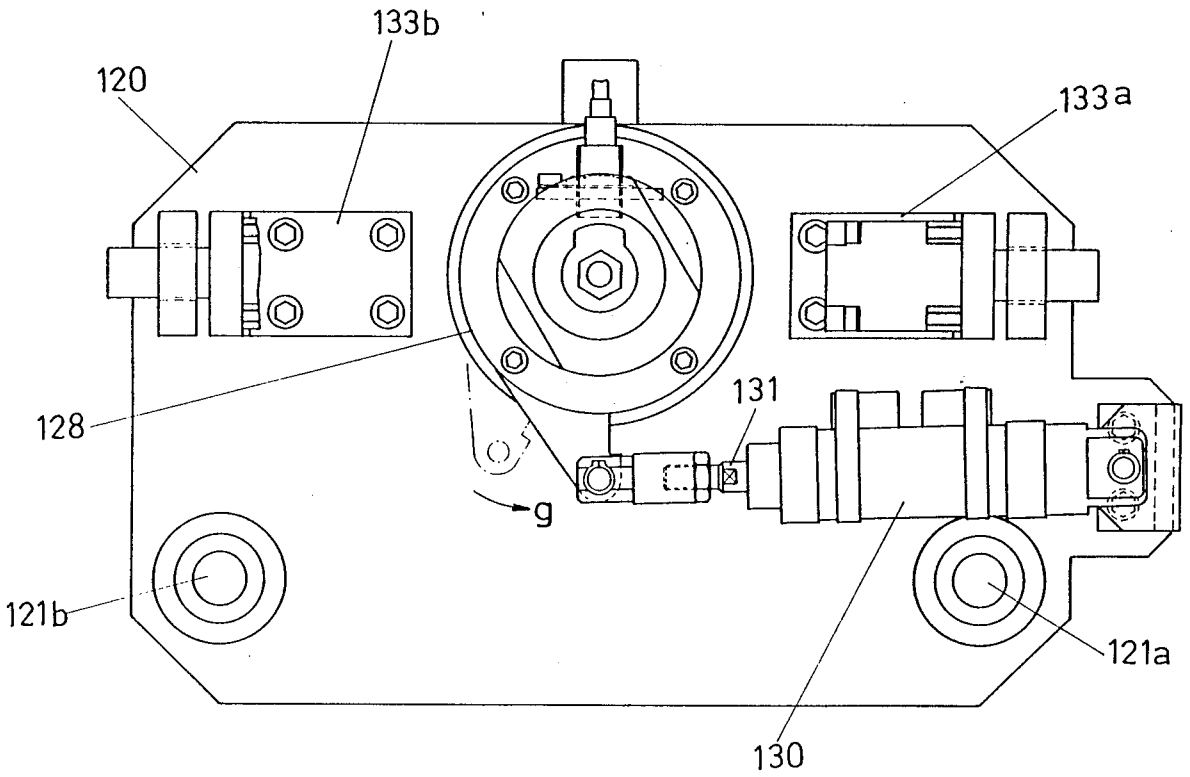
FIG. 11 is a bottom plan view of FIG. 9.

Referring next to FIGS. 9–11, there is shown an example of the manipulator which handles the lid so that the lid can automatically be mounted to or demounted from the barrel, and which can travel toward or away from the barrel. This manipulator may be provided on the machine frame 30 just about where the lid is to be removed from the barrel. The manipulator includes a fluid-operated cylinder 118 which is placed on the machine frame 30. The fluid-operated cylinder 118 has a piston rod 119 whose forward end is secured to a lift plate 120. The lift plate 120 has two guide bars 121*a* and 121*b* which travel slidably through the corresponding housings 122*a* and 122*b* mounted on the machine frame 30. Furthermore, the lift plate 120 has a reversible nut runner 123 which is per se known and is fixed at the position opposite to the bolt 111. This nut runner 123 travels up and down through a recess 124 provided in the machine frame 30. Air is introduced into the nut runner 123, causing the nut 125 located at the top end to turn. When the nut 125 reaches its preset torque, this is detected by a torque detector (not shown) which responds by stopping the nut 125. The nut 125 may be turned reversely by changing the direction of the air supply. Below the location on the lift plate 120 where the nut runner 123 is mounted to the lift plate, there is a boss 127 as shown in FIG. 10, into which a flanged pipe 128 is inserted. The flanged pipe 128 has a forked bottom end 129 which can engage the central portion of the tightening rod 105. The flanged pipe 128 also has a portion extending therefrom, to which the forward end of a piston rod 131 from a fluid-operated cylinder 130 is rotatably secured. The fluid-operated cylinder 130 is mounted to the lift plate 120. Details are shown in FIG. 11. In FIG. 11, fluid-operated cylinders 133*a* and 133*b* are provided on the lift plate 120, and which are mounted on either side of the lift plate 120, and each has a piston rod whose forward end is secured to a lever 134 which extends downwardly, as shown in FIG. 10. The lever 134 has a manipulating pawl 135 at its forward end, which can engage the recesses in the corresponding projecting portions 116*a*, 116*b* on the lid when the piston rods of the fluid-operated cylinders 133*a*, 133*b* are withdrawn, thereby joining the lid 104 and lift plate 120 together.

A micro switch 138 is provided on each of the flanged pipe 128 and boss 132. These micro switches 138 are actuated when the nut 125 is operated, and ensure that the nut 123 has accurately mated with the hexagonal-head bolt 112 by counting the number of turns of the nut as previously established. Each of the fluid-operated cylinders 133*a* and 133*b* has a reed switch which is per se known and is actuated when the lift plate 120 reaches the uppermost position or lowermost position.

Now, the operation of the manipulator is described.

For the lid releasing operation:

(1) Initially, it is assumed that the lift plate 120 is placed at the uppermost position with the pawl 135 open. Then, when pressurized fluid is introduced into the piston side of the fluid-operated cylinder 118, the piston rod 119 advances from the cylinder 118, causing the lift plate 120 to be lowered to the lowermost position. This causes the hexagonal-head bolt 112 and nut 125 to mate with each other, while causing the forked end of the flanged pipe 128 to engage the central portion of the tightening rod 105;

(2) Next, the amount of air as previously defined is introduced into the nut runner 123, causing the nut 125 to turn in the direction of arrow a. When the nut 125 has reached the number of turns as previously specified, it is stopped. This number of turns is detected by the micro switch 138 which checks that the nut 125 has turned by that required number;

(3) The threaded rod 111 which is now engaged by the nut 125 is then turned, causing the tightening rod 105 to advance in the direction of arrow b in FIG. 8. When the tightening rod 105 has completely advanced, the pawls 109 on the tightening rod 105 are moved away from the flange 102 on the barrel 7*a*, releasing the barrel;

(4) A pressurized fluid is introduced into the piston side of the fluid-operated cylinder 130 so that the piston rod 131 is forwarded from the cylinder. This action causes the flanged pipe 128 to rotate in the direction of arrow g in FIG. 11. Then the tightening rod 105 is turned in the direction of arrow c in FIG. 7 until it comes flush with the lateral wall of the barrel where it is stopped. When this turning is completed, the pawls 109 on the tightening rod 105 are completely apart from the flange 102 on the barrel. Thus, the barrel is completely freed;

(5) Then the pressurized fluid is drawn into the piston rod sides of the fluid-operated cylinders 133*a*, 133*b*. This pushes the piston rod backward, allowing the pawls 135, 135*a* to engage the recesses in the corresponding projection portions 116*a*, 116*b*; and (6) Finally, pressurized fluid is drawn into the piston rod side of the fluid-operated cylinder 118. The piston rod 119 is then withdrawn back toward the cylinder, causing the lid 104 to be raised together with the lift plate. This concludes the lid releasing operation.

For the lid closing operation:

(1) Generally, the lid closing operation is carried out by reversing the steps for the lid releasing operation. Specifically, the lid 104 is lowered onto the opening at the top of the barrel 7*a*, and the pawls 135, 135*a* are then opened;

(2) Next, the tightening rod 105 is turned in the direction of arrow d in FIG. 7 and then the pawl 109 is made to engage the flange 102 on the barrel 7*a*; and (3) Then air is forced into the nut runner 123 through the passage opposite to that for the lid releasing operation, causing the nut 125 to rotate in the direction of arrow c in FIG. 7. Thus, the tightening rod 105 moves away from the barrel in the direction of arrow f in FIG.

8. This forces the lid 104 against the opening edge at the top of the barrel, causing the pawl 109 to engage the flange 102. In this way, the barrel is hermetically closed by the lid. During this step, the torque detector mounted on the nut runner 123 senses the amount of torque as previously established, and responds by stopping the nut. At the same time, the micro switch is actuated when the specific number of turns for the nut has been reached. The combination of the torque detector and micro switch ensures that the threaded rod 111 has accurately mated with the threaded hole 110 through the tightening rod 105.

The following description is provided for illustrating the construction and operation of the lid cleaning unit C.

Referring to FIG. 2, the lid cleaning unit C is provided adjacent to the lid closing/opening unit above the machine frame 30. This cleaning unit C is placed below the lid when it is removed from the barrel, and cleans the packing inside the lid. Its details are shown in FIGS. 12 and 13.

Figure 12:
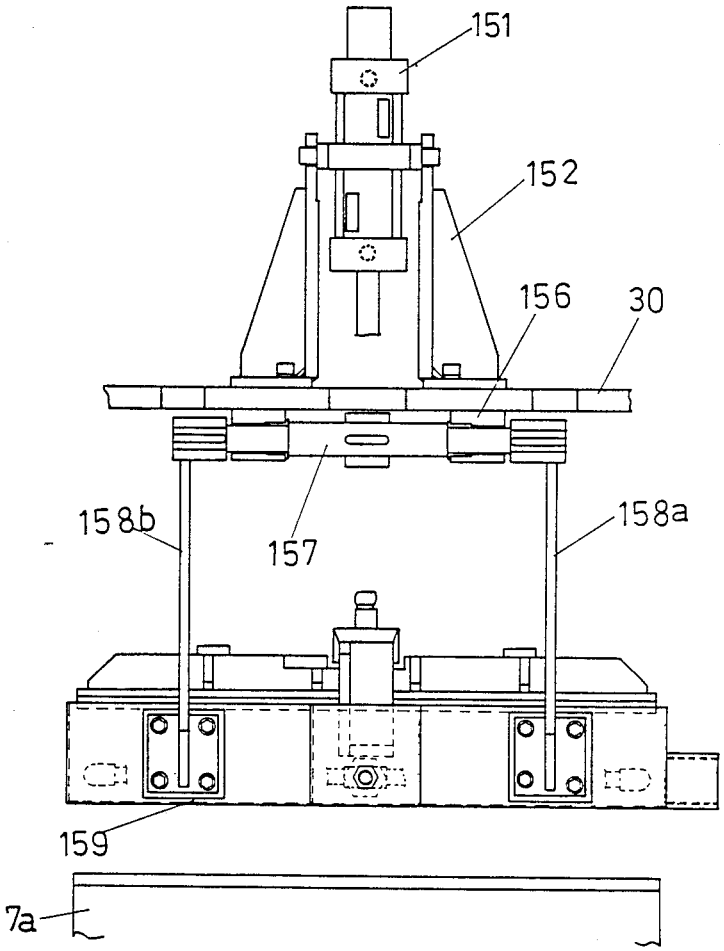
FIG. 12 is a front view of the barrel-lid cleaning unit.
Figure 13:
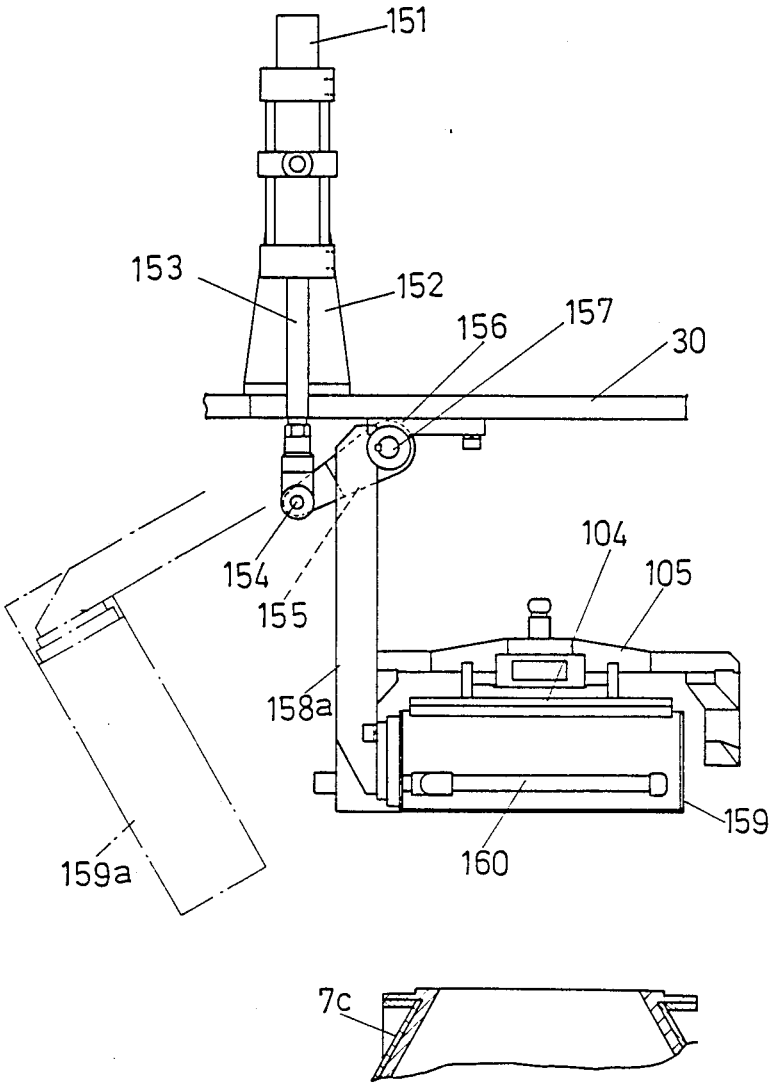
FIG. 13 is a side view of FIG. 12.

In FIGS. 12 and 13, there is a fluid-operated cylinder 151 on the machine frame 30 having an aperture therethrough. A flange 152 extends upwardly from the machine frame 30 on which the fluid-operated cylinder 151 is mounted for swinging movement through small angles with regard to the flange 152. The fluid-operated cylinder 151 has a piston rod 153 extending downwardly, and a shaft 154 is secured to the forward end of the piston rod 153. The shaft also is connected to a small crank 155 at one end thereof, the other end of which is supported by a shaft 157 which is rotatably journalled in a bearing assembly 156 mounted beneath the machine frame 30 and adjacent to the fluid-operated cylinder 151. The shaft 157 also carries levers 158*a*, 158*b* which extend downwardly and to the bottom ends on which a cleaning cage 159 is secured. The cleaning cage 159 contains a cleaning pipe 160. As shown in FIGS. 12 and 13, the cleaning cage 159 is placed below the lid 104 which is now removed from the barrel 7*c* and is above the barrel 7*c* which is open. The cleaning pipe 160 has a nozzle which is directed toward the lid 104, from which a jet of water is forced against the lid 104, when the cleaning cage 159 is placed in the position as indicated in FIGS. 12 and 13. When the fluid-operated cylinder 151 is actuated, causing its piston rod 153 to advance, the cleaning cage 159 is brought to the position as shown, and is ready to clean the lid. When the piston rod 153 moves back toward the cylinder in FIG. 12, the cleaning cage 159 is brought away from the lid to the position 159*a* as shown in phantom lines in FIG. 13. This allows the lid to be remounted on the barrel 7*c*, and the barrel is now ready for the finishing operation.

Figure 6:
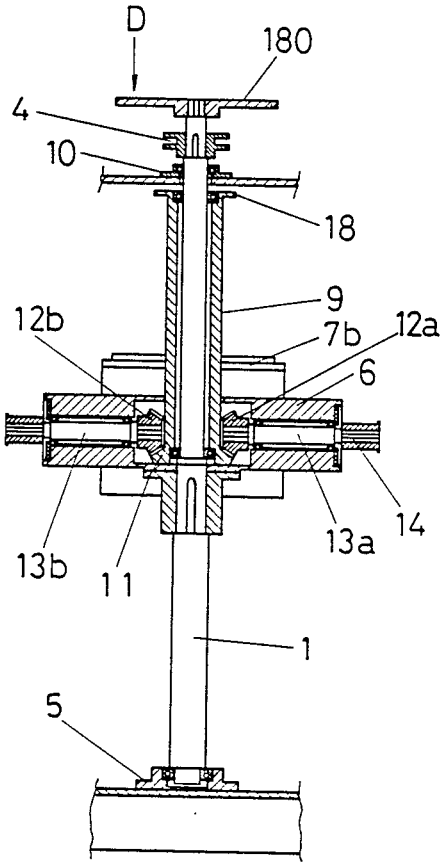
FIG. 6 is a diagram for the embodiment in FIG. 4 for explaining the functional parts or elements thereof.
Figure 6:
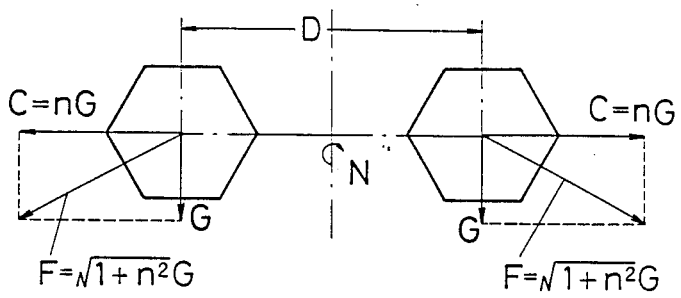
Figure 6:
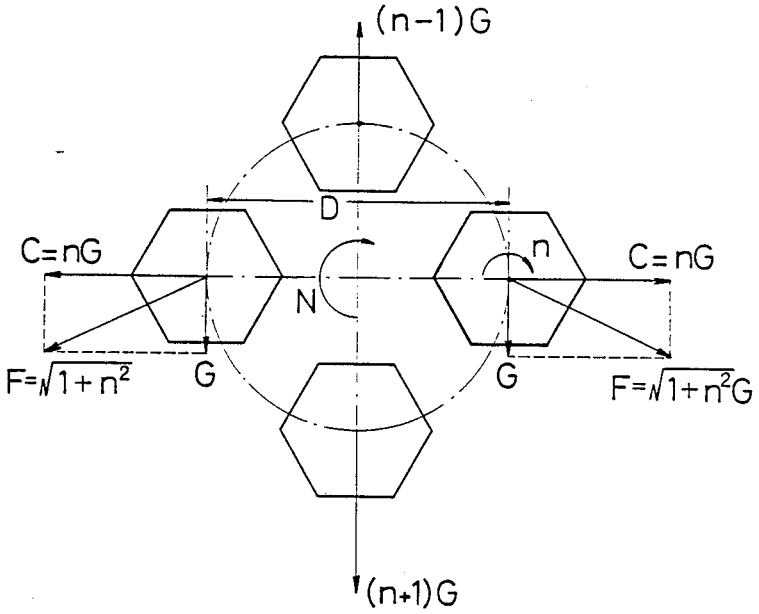
Figure 14:
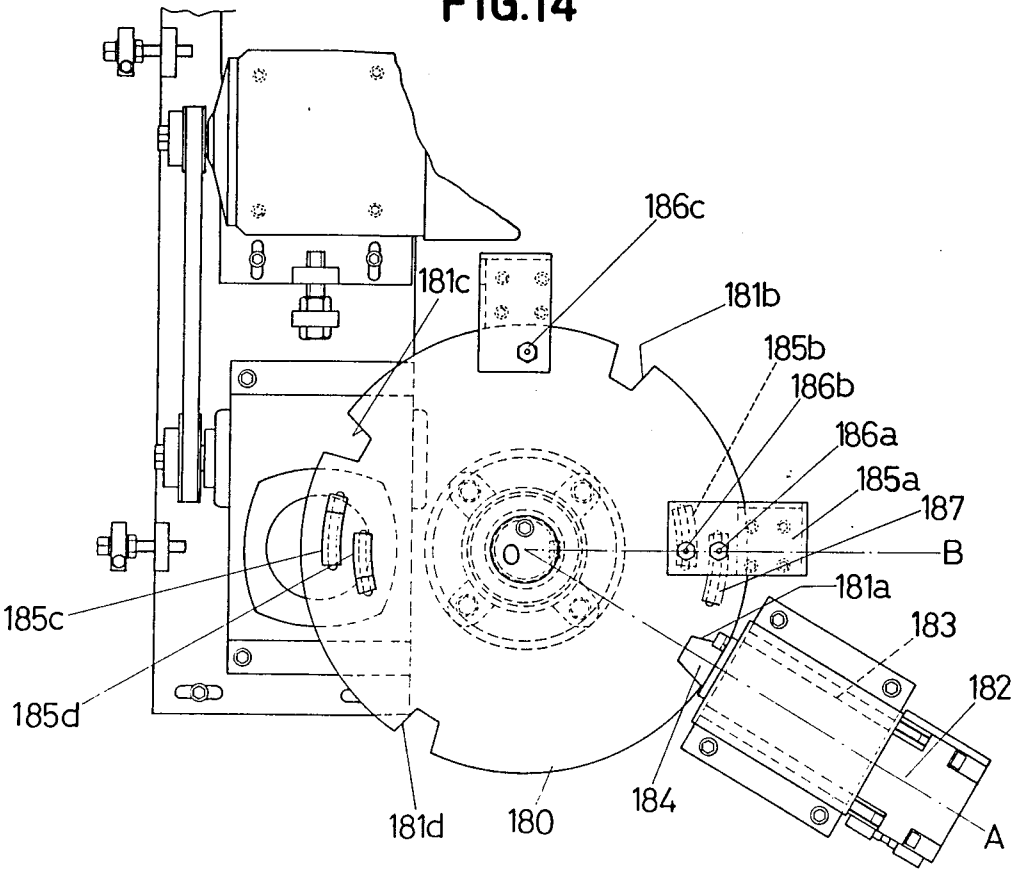
FIG. 14 is a plan view of the barrel-shaft positioning unit.
Figure 15:
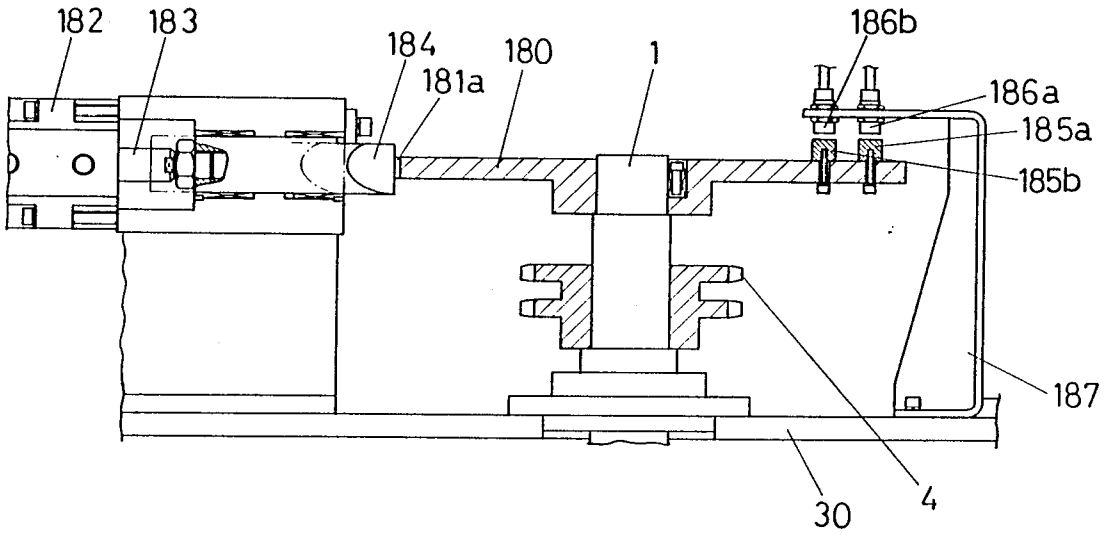
FIG. 15 is a sectional view taken along the line AOB in FIG. 14.
Figure 16:
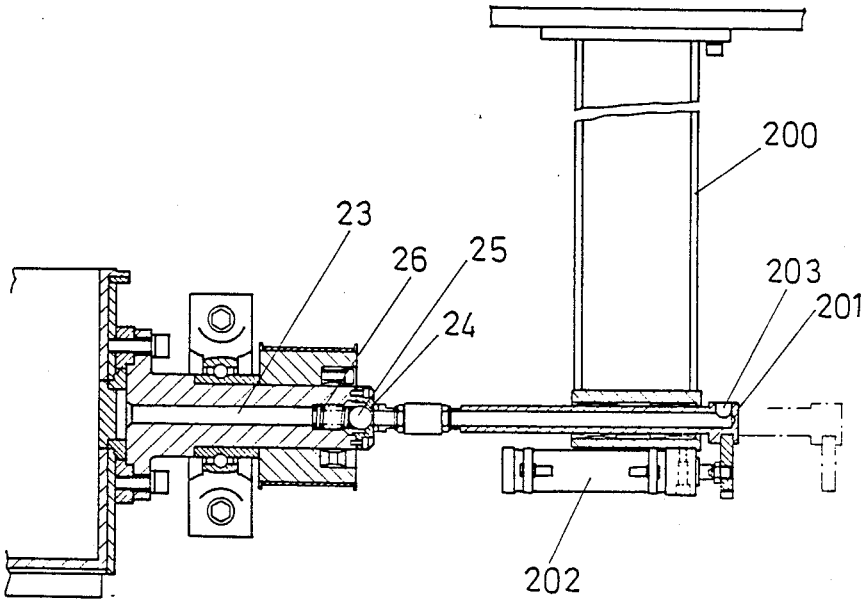
FIG. 16 is a front view of the compound supply unit.

Referring to FIGS. 14 and 15, a main spindle positioning unit D is described. Generally, it is shown in FIGS. 1, 2 and 6. This unit D is mounted on the top end of the main spindle 1, and includes a positioning plate which is secured to the top end of the main spindle as shown in FIGS. 6 and 15. The positioning plate 180 has a plurality of recesses around its peripheral margin as shown in FIG. 14. For the present preferred embodiment as shown and described, it is assumed that two barrels are provided as earlier mentioned, and therefore a total of four recesses are provided, one pair of two recesses being used for each barrel. In each pair, one recess may be used for positioning the corresponding barrel when a mass is to be placed into the barrel, and the other may be used for positioning the barrel when the mass is to be removed from the barrel. These recesses are indicated as 181*a*, 181*b*, 181*c* and 181*d*. A fluid-operated cylinder 182 which is specifically used for the main spindle positioning is mounted to the machine frame 30, and has a piston rod 183 which carries a stopper 184. This stopper 184 may engage any of the recesses 181*a*, 181*b*, 181*c*, and 181*d* when the piston rod 183 advances. When the stopper 184 has engaged any recess, the positioning plate 180 or main spindle 1 is stopped in that position. Thus, the appropriate barrel may be placed in the positions at which a mass is to be placed into and removed from the barrel. The positioning plate 180 also has dogs 185*a*, 185*b*, and micro switches 186*a*, 186*b* mounted to an arm 187 extending from the machine frame 30 responds to those dogs when they come in contact with the micro switch 186*a*. The micro switch provides an appropriate control signal which stops the main motor 2. It may be seen from FIG. 14 that one pair of dogs 185*a* and 185*b* is provided for correcting any possible slight positioning errors that may occur during the rotation in one direction by causing the positioning plate 180 to rotate in the opposite direction. Another pair of dogs 185*c* and 185*d* which are located diametrically opposed to the first pair is provided for the other barrel. An additional micro switch 185*c* which is located 90° from either of the pairs is provided for allowing a mass to be placed into the corresponding barrel. A compound may be placed into the barrel through a feed hole extending through the barrel shaft 8*a*, 8*b* which is provided with a ball valve on the entry side. As shown in FIG. 16, the ball valve includes a valve seat 24 mounted on the entry side of the feed hole 23, and a ball 25 which is normally biased by a spring 25 toward and against the valve seat 24, thus preventing any compound from entering the barrel. A compound supply unit E is shown in FIG. 3 or 16, which has a feed nozzle 201 which is mounted slidably with regard to a frame 200 fixed to the ceiling of the machine frame 30. A fluid-operated cylinder 202 which is secured to the frame 200 controls the feed nozzle 201 so that it can have a sliding motion. A delivery pipe (not shown) extends from the entry side of the compound supply unit E to a compound supply tank (not shown). A delivery pump (not shown) is interposed between the unit E and supply tank. Whenever a compound is supplied, the delivery pump is started, delivering an adequate amount of compound from the tank into the barrel. During this delivery, the feed nozzle 201 is controlled by the fluid-operated cylinder 202 so that the tip is forced upon the valve seat 24. Then, the compound flow delivered under pressure from the pump depresses the ball 25, opening the ball valve to allow the compound flow to pass through it. The amount of compound to be supplied may be controlled by a timer. After the time period previously set by the timer elapses, the supply of the compound is stopped. Then, the ball 25 is forced back against the valve seat 24 under the action of the spring, closing the passage through the valve.

Figure 17:
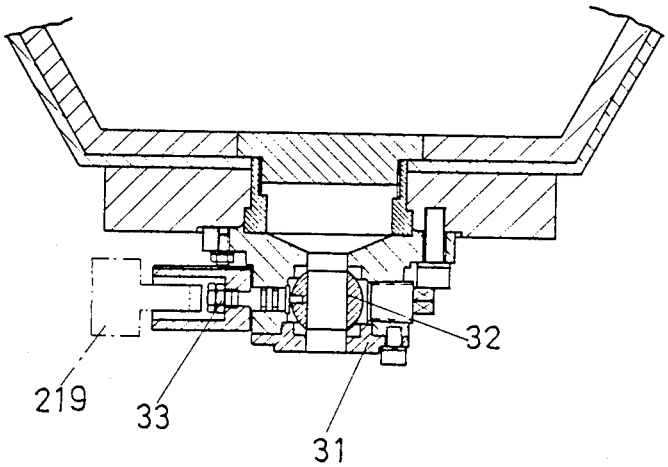
FIG. 17 is a partly enlarged view of FIG. 16.
Figure 18:
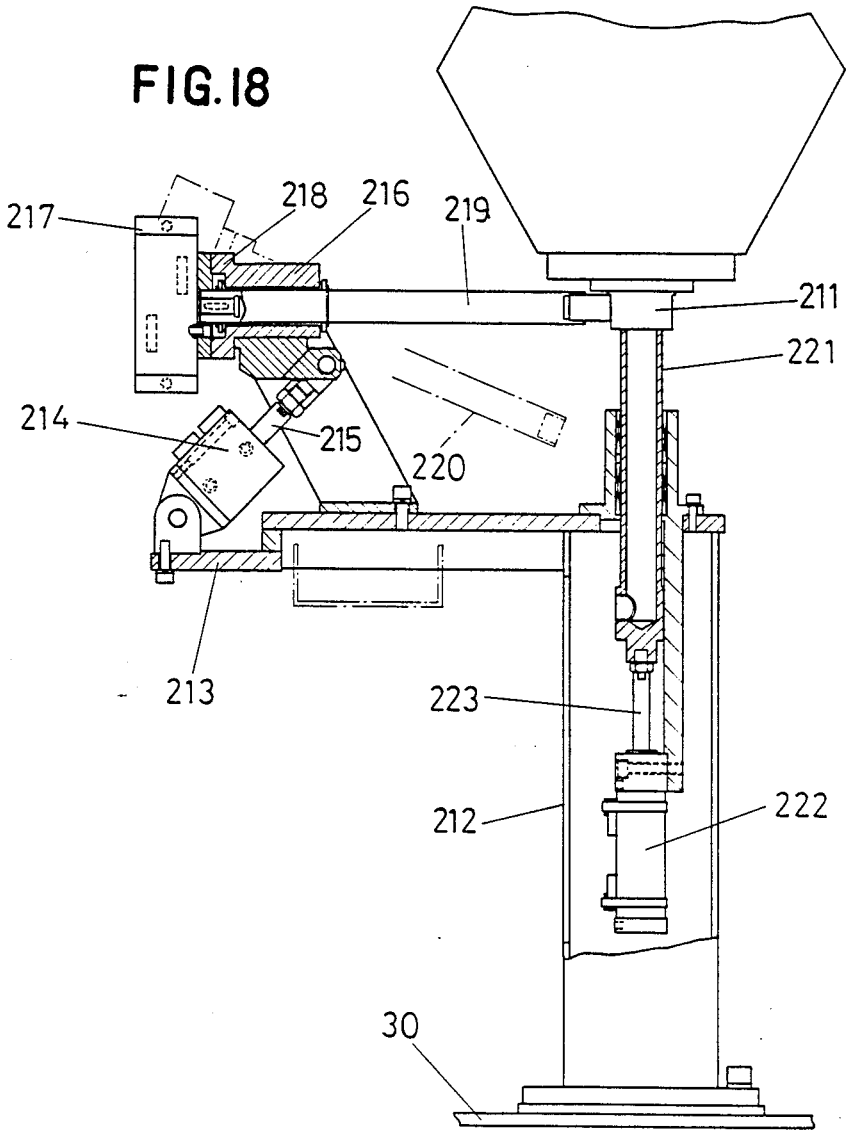
FIG. 18 is a plan view of the water draining unit.

A compound/water draining unit F is shown in FIGS. 17 and 18. This unit is located on the side of the barrel opposite the lid, and is supported by a barrel side plate. As shown in FIG. 17, the unit F includes a ball valve assembly 211 having a ball valve seat 31 mounted on the barrel side plate and a ball valve 32 rotatably mounted on the valve seat 31. The ball valve 32 has a passage through it, and the ball valve seat 31 has a passage through it which can communicate with the passage through the ball valve 32. That is, the ball valve 32 may be rotated, allowing or shutting off communication between the two passages. This rotation of the ball valve 32 can be achieved by a lever 33 which is connected to the ball valve 32 on one side thereof. A rotary rod 219 is disconnectably connected to the lever 33. The details are shown in FIG. 18. Referring to FIG. 18, a support member 212 extends upwardly from the machine frame 30, and a plate 213 extends outwardly from the support member 212. A fluid-operated cylinder 214 is swingably mounted to the plate 213 for movement through small angles with regard to the plate 213. The fluid-operated cylinder 214 has a piston rod 215 whose forward end carries a ball valve driver 216 which is pivotally mounted for movement through small angles. The ball valve driver 216 includes a rotary actuator 217 and a rod 218 which is connected to the rotary rod 219. The rotary rod 219 can engage the lever 33 when the piston rod 215 of the fluid-operated cylinder 214 advances toward the lever 33. The lever 33 is then driven for rotation by the rotary actuator 217, and thus the ball valve is rotated. When the piston rod 215 is withdrawn, the rotary rod 219 is disengaged from the lever 33, and is moved pivotally down to the position indicated by the phantom lines 220 to ensure the unhindered rotation of the barrel. The compound or any cleaning water than remains in the barrel is drained through the ball valve 32 into a drain conduit 221 extending through the support member 212, from which it is delivered onto a mass separator 11 which will be described later. The drain conduit 221 may be moved up and down by a fluid-operated clyinder 222 secured to the support member 212. The fluid-operated cylinder 222 has a piston rod 223 which is connected to the drain conduit 221. When the piston rod 223 advances, it raises the drain conduit 221 until it reaches the valve seat 31, where the drain conduit 221 can communicate with the valve seat 31. When the piston rod 223 is retracted, it lowers the drain conduit away from the valve seat 31. Thus, the barrel can rotate unhindered by the drain conduit 221.

Figure 19:
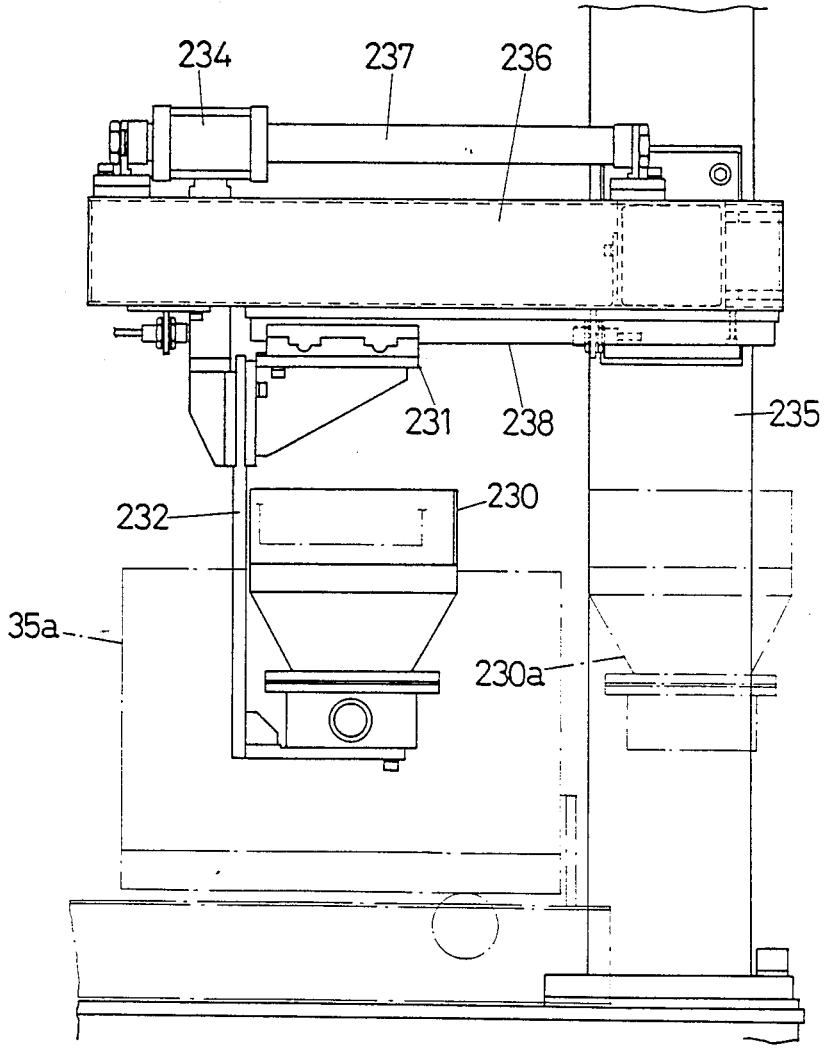
FIG. 19 is a front view of the abrasive media hopper forming part of the vacuum transfer unit.
Figure 20:
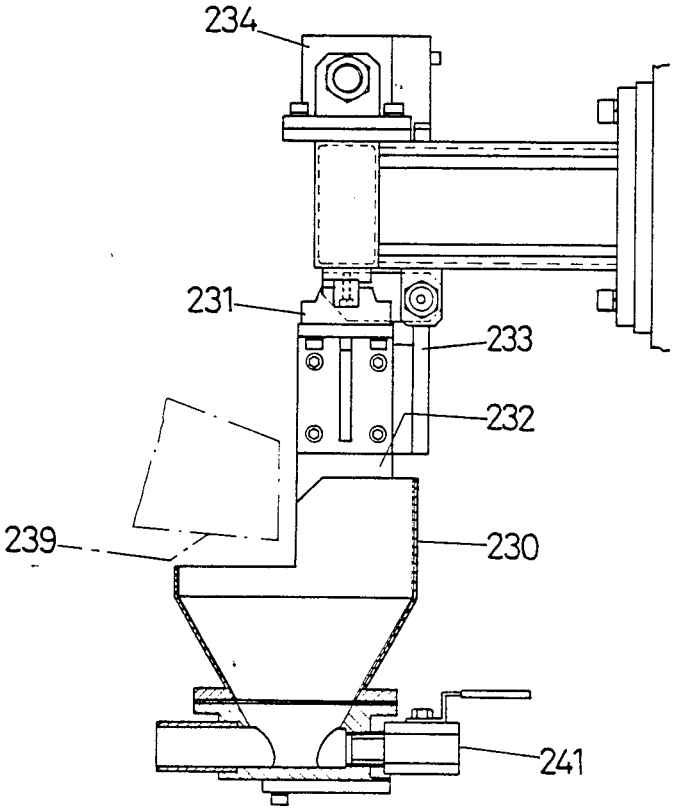
FIG. 20 is a side view of FIG. 19.

The vacuum transfer unit G is shown in FIGS. 19 and 20. This vacuum transfer unit G includes a vacuum tank 321 (see FIG. 1) which receives through an inlet the abrasive media from a mass separator unit, and delivers it under vacuum.

Referring to FIGS. 19 and 20, an abrasive media accepting hopper 230 is supported by a support member 232 which is connected with a linear traveler 231 and extends downwardly therefrom. A support member 233 which is secured to the support member 232 supports a rodless cylinder 234. A support member 235 extends upwardly from the machine frame 30, and a traverse member 236 is supported by the member 235. There is a guide 237 for the rodless cylinder 234 which runs above the traverse member 236, and there is a guide 238 for the linear traveler 231 below the traverse member 236. When the hopper 230 is placed in the position as indicated by the solid lines in FIG. 19, a mass separator unit has an outlet 239 positioned above the hopper 230. When the same abrasive media that has been used during the preceding operation is again to be used without changing it to a different or new one, a bucket 35*a* is placed in the position shown instead of the hopper 230 which has been moved away from that position, and the abrasive media placed from the mass separator unit is dumped into the bucket 35*a*. When the old abrasive media is useless or a new or different abrasive media is to be supplied, the hopper 230, which is in the position 230*a* shown by the phanton lines in FIG. 19, is then moved to the position shown by the solid lines in FIG. 19. At this time, the new or different abrasive media is moved from the mass separator unit into the hopper 230. In either case, the abrasive media in the hopper 230 is then delivered to the vacuum tank 321 (shown in FIG. 1). This delivery may be achieved by allowing any appropriate vacuum suction unit (not shown) to force the ball valve 241 open.

The mass separator unit H is provided below the barrel. This mass separator unit H is moved down and away from the barrel during the barrel operation to ensure unhindered rotation of the barrel. When the operation is completed and the mass including the workpieces and abrasive media is to be accepted by the mass separator unit H, it is moved up as close as possible to the barrel. This is to prevent any possible damage to the finished workpieces when they are transferred together with the abrasive media from the barrel to the mass separator unit below it.

Figure 21:
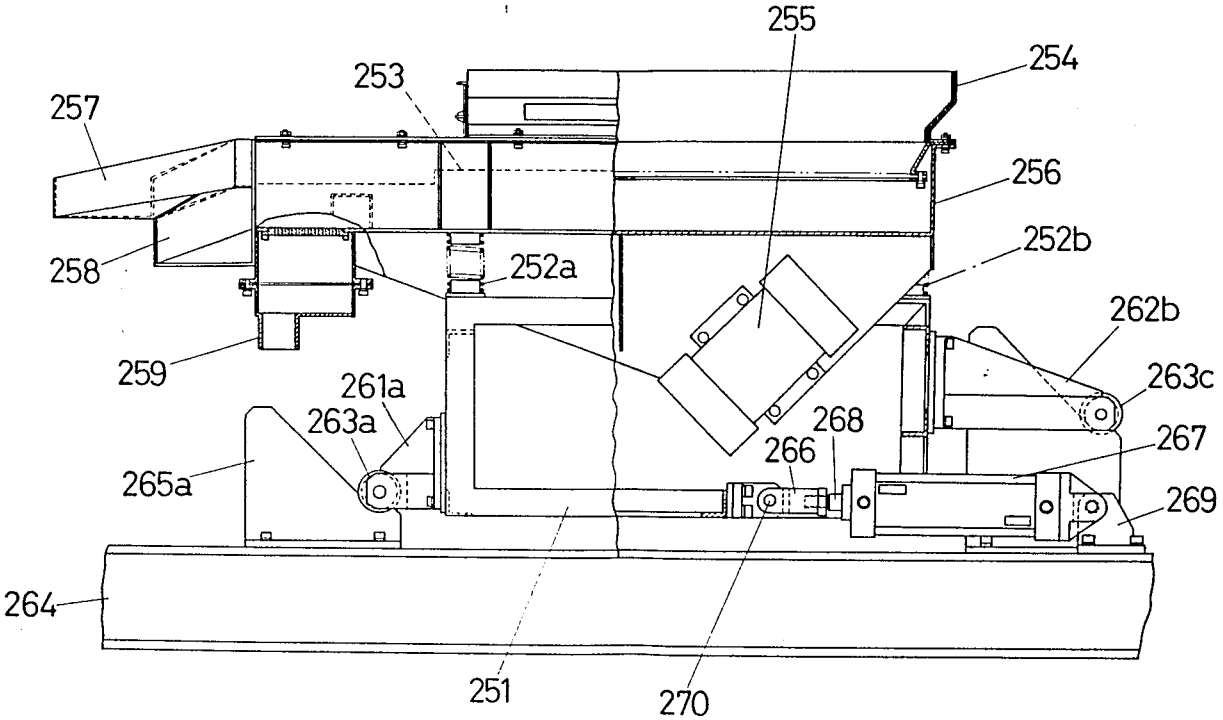
FIG. 21 is a front view of the mass separator.
Figure 22:
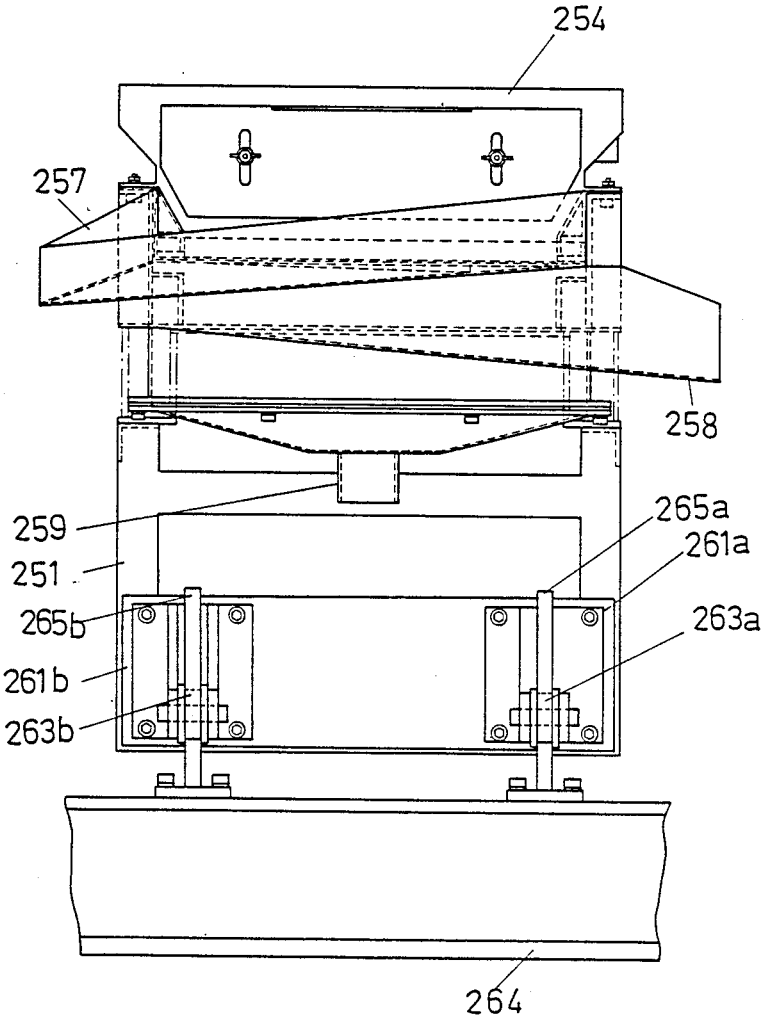
FIG. 22 is a side view of FIG. 21.

Referring now to FIGS. 21 and 22, an example of the mass separator unit H is described, its location being shown in FIG. 1. FIG. 21 is a side view of the unit, with its outer appearance shown in the left-hand side and its internal details shown on the right-hand side. It comprises a box 251 which is placed on the base 254. There are several springs (such as the four shown) 252*a*, 252*b*, 252*c* and 252*d* on the box 251, which springs support a sieve 256 above it. The sieve 255 has a mesh plate 253 such as a metal net, grill, apertured plate, etc. The mesh plate 253 provides the filtering action. The sieve 256 also has an inlet 254 through which the mass may be led from the barrel onto the mesh plate 253, when the barrel is turned over. A vibration generation motor 255 causes vibration of the spring-loaded sieve 256. That is, when the motor 255 starts, its output power is transmitted to the sieve plate 253 supported by the springs 252*a*, etc. allowing the finished workpieces to remain on the sieve plate 253 while causing the abrasive media to pass down through it and to be collected in the hopper 230. The finished workpieces remaining on the sieve 256 (what should remain are usually the workpieces but in some particular cases it may be the abrasive media) are collected through the outlet 257 above the sieve. The abrasive media that has passed through the sieve (similarly, what should pass are usually the abrasive media but in some particular cases it may be the workpieces) goes through the outlet 258 below the sieve into the hopper 230 or bucket 35 as shown in FIG. 19. If the mass contains the compound, it is collected through the drain conduit 259.

As the barrel turns either about its own axis or around the turret, or both, during the normal operation, the mass separator unit should be moved away from the barrel in order to ensure unhindered operation of the barrel. When the operation is completed, the mass separator unit should be moved back as close as possible to the barrel. This may be achieved in the following manner. That is, the box 251 has flanges 261*a*, 261*b*, 262*a*, 262*b* located on the lower side and extending outwardly therefrom and rollers 263*a*, 263*b*, 263*c*, 263*d* are rotatably mounted to the corresponding respective flanges. The base 264 has guides 265*a*, 265*b*, 265*c*, 265*d* having inclined surfaces facing the corresponding respective rollers. The rollers can travel up and down along the guides. The box 251 has a pin 270 fixed to the lower portion thereof, to which a knuckle joint 266 is pivotally mounted. This knuckle joint 266 is secured to the piston rod 268 from a fluid-operated cylinder 267 which is mounted to a flange 269 extending from the base 264 so that the cylinder 267 can swivel with regard to the flanges 269. Introducing pressurized fluid into the piston side and piston rod side of the cylinder 267 alternately causes the rollers 263*a*, etc. to travel up and down along the guides 265*a*, etc. As the rollers travel up or down, the mass separator unit is brought closer to or away from the barrel.

The above description has been provided for the vibratable sieve, but any other form of the sieve may be employed, such as a magnetic sieve, in any form of the sieve, it may be constructed as described above, such that the rollers mounted beneath the sieve may travel up and down along the inclined guides. Thus, the fluid-operated cylinder can control the box 251 so that it can travel forward and backward, causing the rollers to travel up and down along the inclined guides. This movement can bring the mass separator unit away from the barrel during its operation, or bring it closer to the barrel after its operation is completed. This will ensure unhindered operation of the barrel as well as prevent any possible damage that may occur to the finished workpieces when they are left to fall onto the sieve. The inclined guides can have the mechanically strong and stable structure that will provide accurate and trouble-free operation. Thus, it will have an extended life.

Figure 23:
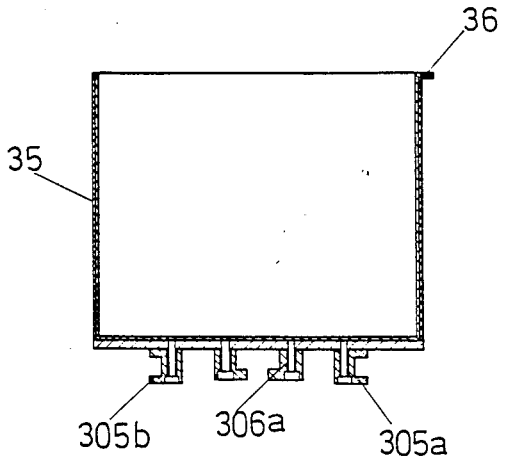
FIG. 23 is a front view of a bucket.
Figure 24:
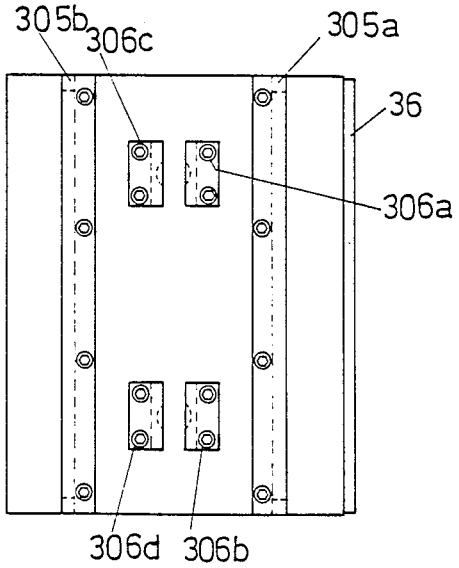
FIG. 24 is a bottom view of the bucket in FIG. 23.
Figure 26:
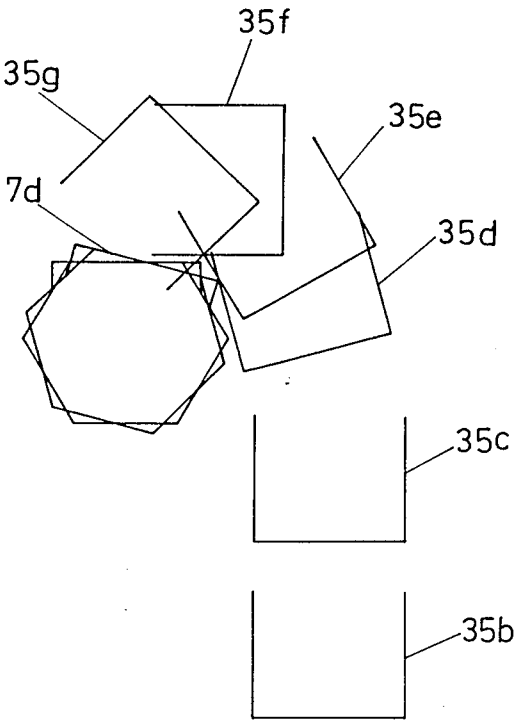
FIG. 26 illustrates the position of the bucket in relation to the barrel when the bucket is being turned over.
Figure 25:
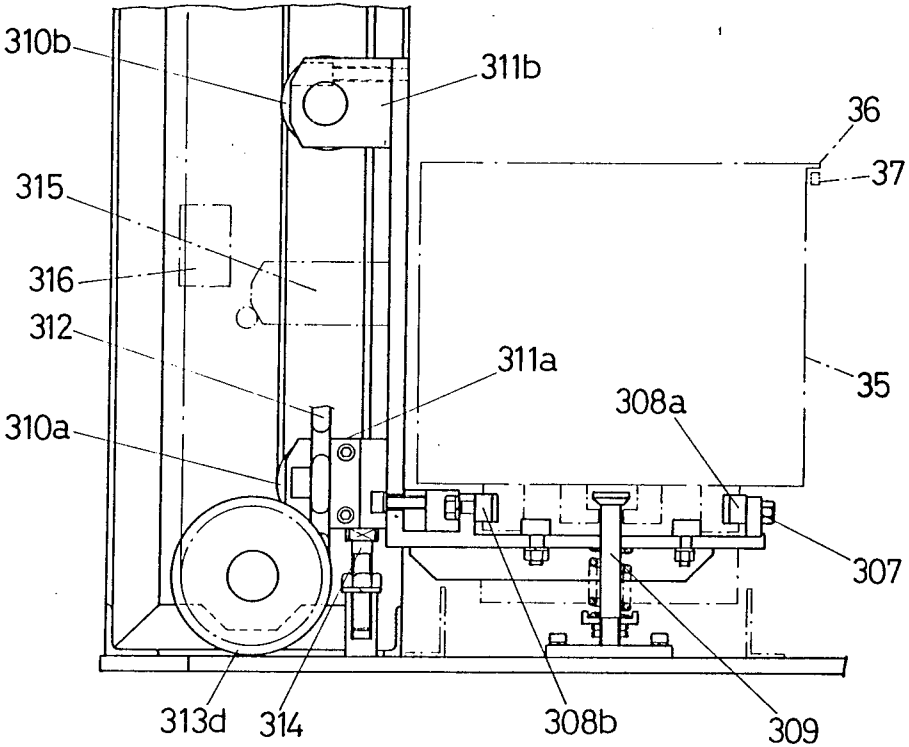
FIG. 25 is a front view of the lower portion of the bucket turn-over unit.

The bucket transfer unit J is now described. Referring to FIGS. 1 and 2, this unit is located below the machine, and connects between the later described abrasive media supply unit K and the already described mass separator unit H. Rollers 300*a*, etc. are arranged between the above two units, the rollers being supported by roller shafts through them. Each roller shaft carries a chain wheel which is driven by a roller drive motor 301. When the rollers are driven, a bucket can travel along the rollers. The bucket may be stopped at several locations such as the abrasive media accepting hopper 302, bucket turn-over unit 303 and the mass separator unit 304. At each location, a micro switch may be provided that is responsive to the presence of the bucket, thereby stopping the bucket at the appropriate location. The bucket 35 has arresters beneath it that can be arrested by the bucket turn-over unit K. As shown in FIGS. 23 and 24, a pair of parallel rails 305*a*, 305*b* and arrestors 306*a*, 306*b*, 306*c*, 306*d* are provided for this purpose. These arresters can engage the corresponding arresters 308*a*, 308*b* on a carrier 307 as shown in FIG. 25, when the bucket 35 is stopped at the bucket turn-over unit location 303. The arresters 306*a*, 306*b*, etc. are held by a retaining rod 309. The carrier 307 has rollers 310*a* and 310*b* which are rotatably mounted on shafts across the carrier 307. The shafts are supported by bearings 311*a* and 311*b* to which a chain 312 is secured. The chain 312 extends upwardly as shown in FIG. 3, and is engaged around chain wheels 313*a*, 313*b*, 313*c*, 313*d*. When this chain 312 is driven by a drive motor (not shown), it will cause the bucket 35 to travel up and down. The lower end of the travel for the bucket is limited by a stop 314. When the bucket is stopped at the lower end of its travel, this can be verified by providing a limit switch 315 that will respond to a dog 315 on the carrier 307. When the mass in the bucket is to be placed into the barrel at the bucket turn-over unit, the bucket will be turned over as shown by 35*g* until part of it can enter the barrel, while the barrel is slightly inclined as shown by *7d* to accept that part of the bucket, thereby minimizing the fall between the bucket and barrel and avoiding any possible damage to the finished workpieces.

An abrasive media supply unit K is generally shown in FIGS. 1 and 2. In the example shown and described, the unit K includes five hoppers 320*a*, 320*b*, 320*c*, 320*d*, 320*e*, each of which may correspond to a different type of abrasive media. Support members 324*a*, 324*b*, 324*c*, and 324*d* extend upwardly at the four corners of a base 323, and a traverse top plate 325 is disposed on top of the support members. A main spindle 326 is disposed on top of the support members. A main spindle 326 is rotatably mounted between the base 323 and top plate 325. The main spindle 326 is driven by a motor 327 which includes a reduction gear 328 and a chain wheel 329. The driving power of the motor 327 is thus transmitted through the reduction gear 328 and chain wheel 329 to the main spindle 326 through the chain wheel 330. A vacuum tank 321 is provided on the top plate 325 to contain the abrasive media. The vacuum tank 321 is located adjacent to the barrel finishing unit A, and has an outlet below it which extends downwardly toward a particular hopper. The outlet is covered with a lid 332, which can be opened or reclosed by a fluid-operated cylinder 333. A turret 334 is mounted to the main spindle 326 at the intermediate portion thereof, the turret 334 carrying the hoppers 320*a*, etc. As described, each hopper accepts a different type of abrasive media. Each of the hoppers has a support casing 335*a*, 335*b*, 335*c*, 335*d* or 335*e* which is fixed to the lower portion of the corresponding respective hopper. Each of the support casings has a rectangular box shape in cross section open at the top, and houses an endless belt conveyor 336*a*, 336*b*, 336*c*, 336*d* or 336*e*. Each belt conveyor is close to the outlet of each corresponding hopper that extends downwardly. Each hopper is equipped with a flap at the outlet which is swingably hinged and which normally closes the outlet end of the conveyor passage. When the conveyor 335*b*, for example, starts running as shown by an arrow, it will force the flap open as the abrasive media on the conveyor travels toward the flap. At the outlet end of the conveyor passage, the abrasive media is allowed to drop into a measuring hopper 338. The measuring hopper 338 is supported by a load cell, and provides an amount of abrasive media as determined by measuring its weight which has previously been specified. When the abrasive media has reached its specified weight, it causes the outlet of the hopper to open, through which the media can be placed into the bucket 35 below the hopper outlet. The selection of a hopper that contains a particular type of abrasive media may be made by allowing the turret 334 to turn until that particular hopper is placed just above the measuring hopper 338. This positioning of the hopper may be achieved by the same positioning unit as described with reference to FIG. 4. A workpiece delivery unit 339 can comprise a known vibratory feeder, which will deliver a specific amount of workpieces into the same bucket 35 as for the abrasive media. The amount of workpieces to be delivered may be determined by a timer that has previously been set. A sensor which is provided above the workpiece delivery unit 339 is sensitive to a workpiece that is passing across the sensor.

Figure 27:
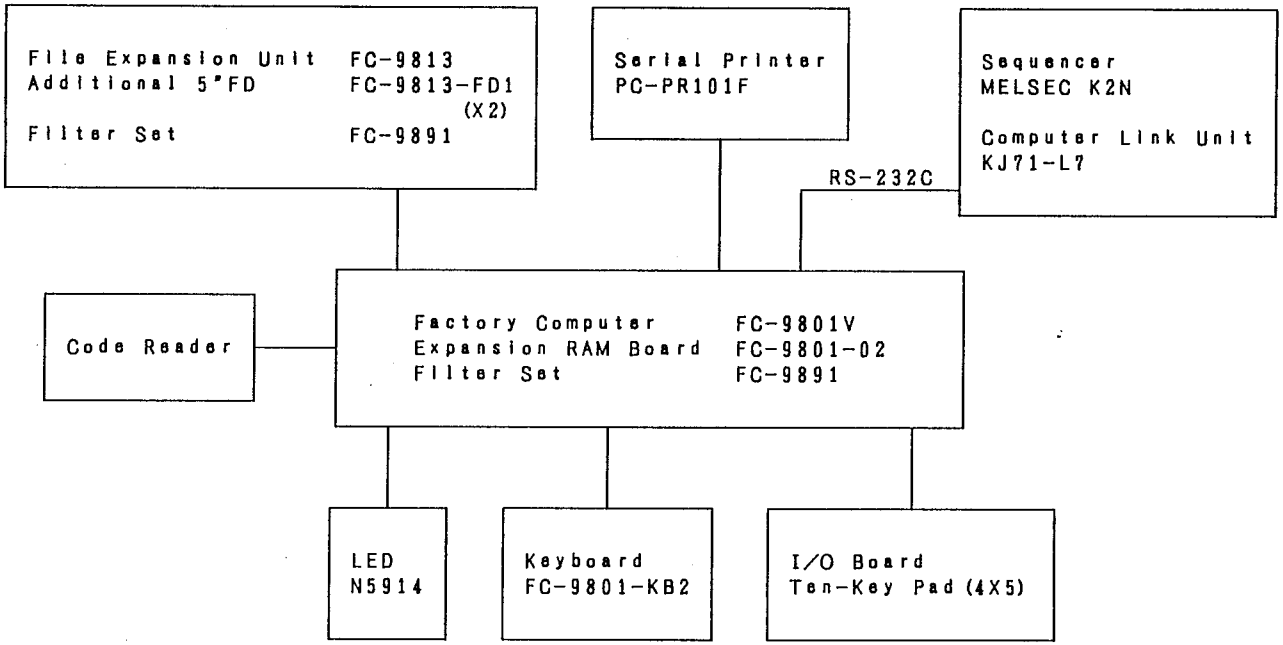
FIG. 27 is a block diagram showing the physical configuration of the controller system including CPU, storage, 1/0, etc.
Figure 28:
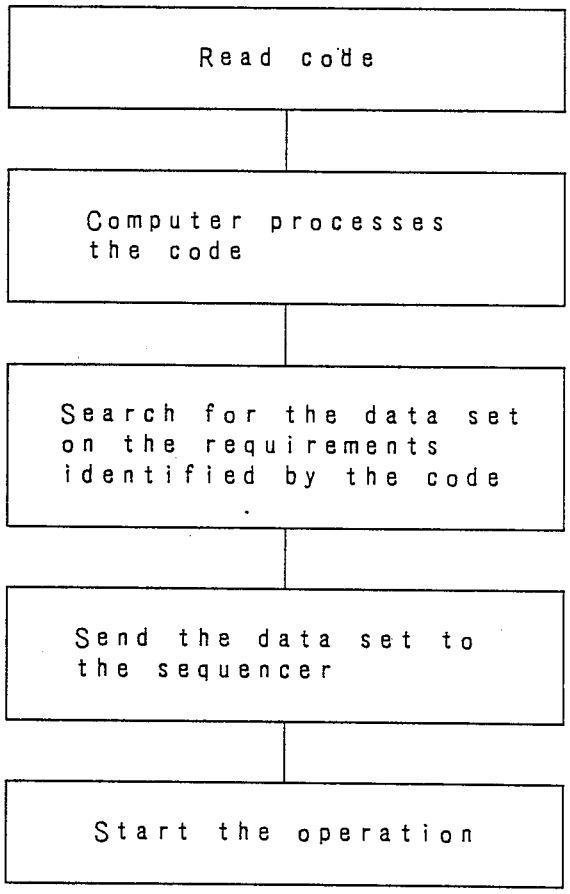
FIG. 28 illustrates the step-by-step block diagram for the controller system.
Figure 29:
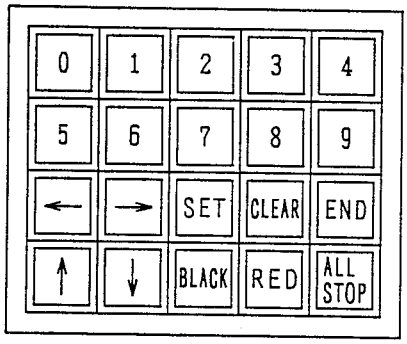
FIG. 29 shows a ten-key pad including the numeral keys and other control keys for the controller system.

The controller functions that may usually be provided by a sequence controller or computer are now described. Those controller functions are programmed to control the sequential operations of all or each of the individual units that have been described above. Each batch of workpieces is identified by a unique code number or identifier that represents a particular type of operation or sequence of operations. This code number is previously stored in an appropriate computer memory or storage, and may be entered by reading it from the batch of workpieces by using any suitable mark reader, or may directly be entered on any suitable keyboard. The code number as entered is then matched against the one stored in the memory, and the operation or sequence that corresponds to that code number can be selected and performed. Every operation or sequence has previously been defined, programmed, and stored in the memory. An initial menu is provided that presents a list of choices such as automatic operation, individual operations, and so on. For example, when the choice "individual operations" is selected, another screen is displayed from which specific jobs may be selected by placing a cursor over the appropriate job name by using the cursor positioning keys and then may be performed by pressing the "BLACK" and "RED" keys of the keypad shown in FIG. 29. The flowchart in FIG. 28 consists of the steps which are generally followed by the computer system. The typical system configuration shown in FIG. 27 includes a central computer such as NEC's factory computer FC9801V, a sequence controller such as Mitsubishi Electric's MELSIC KZN with a computer link unit KJ71-L7, and RS-232C interface which connects to the central computer. Other additional units include 1/0 units such as liquid crystal display (LCD) N5914, keyboard FC9801-KB2, expansion RAM board FC9801-02, file expansion unit FC-9813, additional 5-in floppy disk drive FC-9813-FD1 (two sets), serial printer PC-PR101F, ten-key pad shown in FIG. 29, and so on. The running schedules are managed by the computer which provides various running status data and other information. Instructions or commands are entered which cause the sequence controller to perform the appropriate operation or sequence according to the running schedules, and control the running conditions. As described, each unique code number or identifier is assigned to each different operation or sequence. When a given code number is either entered on the keyboard or read by an optical means such as a mark sensor, the sequence that corresponds to that code number is invoked, and then is performed. Each unit that is associated with each step during the finishing operation may be operated according to the particular sequence. The types of operations that may be performed sequentially are: (1) rotating, (2) heavy rotating, (3) centrifugal flow, individual, (4) rotating-centrifugal flow (or heavy rotating), (5) centrifugal flow (or heavy rotating)-rotating, and (6) rotating-centrifugal flow (or heavy rotating)-rotating. Every sequence may consist of a combination of up to three types of operations.

Figure 30:
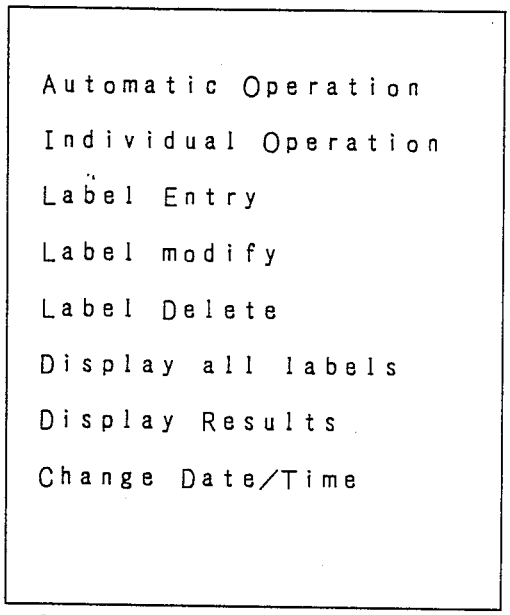
FIG. 30 shows an initial menu screen.

The code number may be recognized by any known means, such as a color monitor, micro switch, magnetic sensor, apertures, bar codes, signal transmission, character or mark recognition, and so on. The code number label that can be read mechanically, optically, or magnetically is previously attached to any proper location on a bucket such as edge 36. This label may be read by any appropriate sensor means 37 which is located on the machine frame 30. The output signal of the sensor means is delivered to the central computer. As shown from the block diagram in FIG. 28, the steps begin with reading the code number through the intermediate operations, and end with starting the finishing operation. The ten-key pad has the key arrangement a shown in FIG. 29. The types of operations may be identified by the "BLACK" key and "RED" key. FIG. 30 shows an intial menu screen that presents a list of choices such as automatic operation, individual operations, label entries (which allow code numbers to be entered as labels and their corresponding sequences to be entered), label modification (which allows the existing labels to be modified), label deletion (which allows the existing labels to be deleted if no longer needed), all label display (which allows all existing labels and associated data to be displayed), finishing result display, and date/time modify. Those items may be chosen by pressing the appropriate number on the ten-key pad. The following description will be provided, assuming that the jobs "automatic operation" and "individual operations" have been selected.

Figure 31:
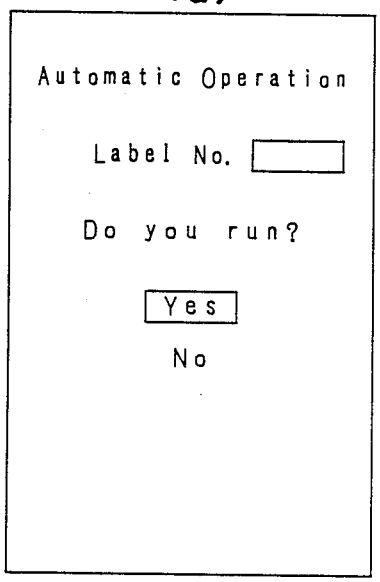
FIGS. 31(*a*) and (*b*) show a screen to be displayed when the "automatic operation" item is selected from the initial menu screen.
Figure 31:
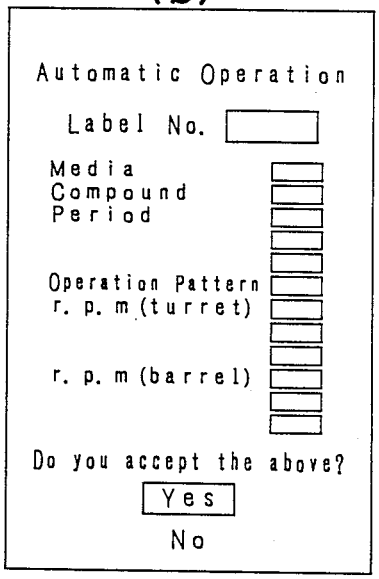
Figure 31:
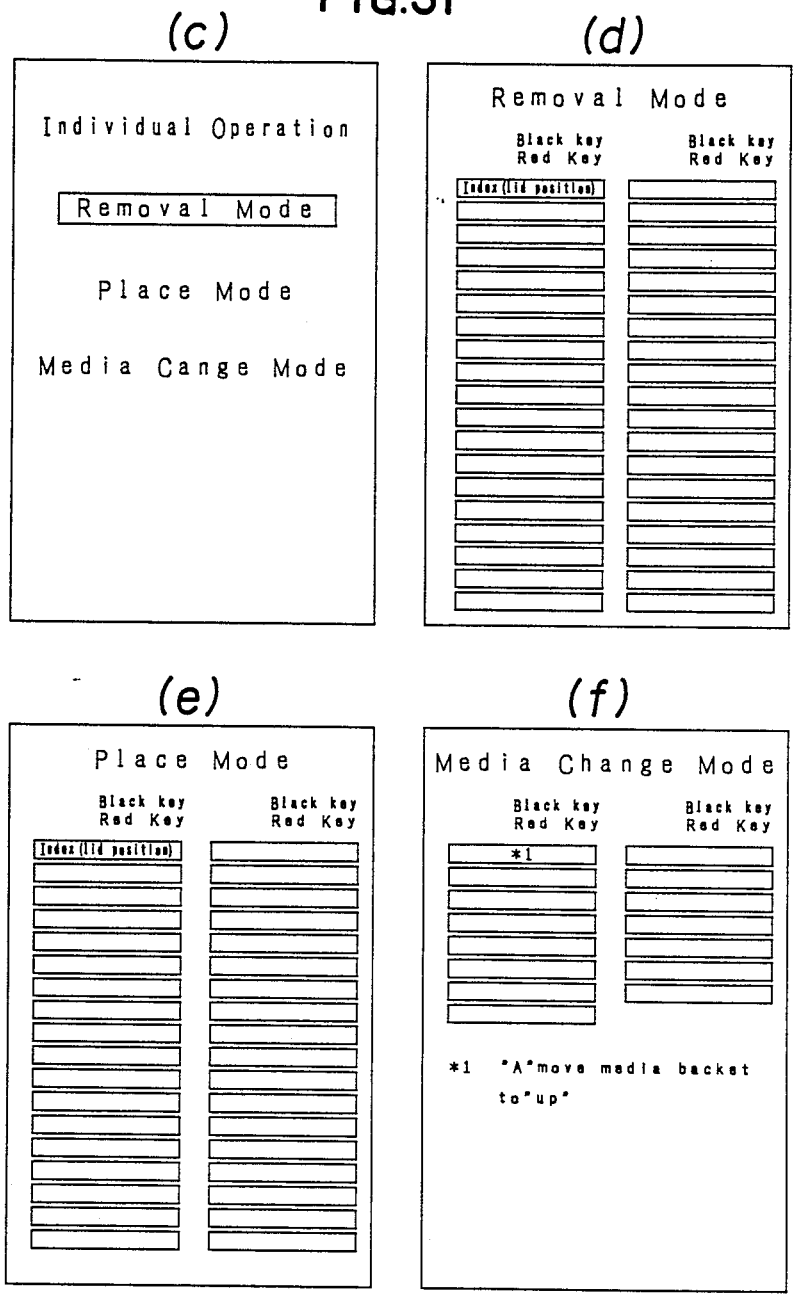

When "automatic operations" is selected, another screen will appear as shown in FIG. 31(*a*) which presents the barrel number as read. If a barrel number is not automatically selected, the ten-key pad may be used from which the appropriate keys corresponding to the particular barrel number may be pressed. Then, the barrel number will appear on the screen. When an instruction is issued to execute the "automatic operation", another screen will appear as shown in FIG. 31(*b*). This screen displays a set of data on the specific requirements that corresponds to the particular code number. If those requirements are accepted, the key "YES" can be pressed. Then, the computer responds to this by sending an appropriate signal to the sequence controller which begins that sequence. If those requirements should be modified, the key "NO" can be pressed. This action causes a label modify screen to appear, from which any necessary modifications may be selected.

During the automatic operation, the status information may appear on the bottom of the display, depending upon whether a normal running exists or any abnormal situation occurs. When the operation is running normally, the status information may include (1) workpieces being delivered, (2) the turret being rotated, (3) the appropriate barrel being rotated, (4) mass being separated, (5) the running time for the particular barrel number, etc. When the status "workpieces being delivered" appears, the signal from the dog 315 on the carrier 307 that is generated when the bucket is turned over, and the signals that are generated by sensing the current flow through the rotating motors associated with the respective rotation and separation are delivered to the central computer. The status information that may appear if any abnormal situation occurs includes (1) emergency stop, (2) insufficient pneumatic pressure, (3) cycle over, (4) overheat, (5) failing sequencer battery, (6) failing sequencer, (7) failing nut runner, (8) failing barrel lid, (9) turn-over unit overrun, (10) no workpieces, and so on. The "emergency" stop" signal is provided by pressing the "EMERGENCY STOP" button, the "insufficient pneumatic pressure" signal is provided by the pressure gauge when it detects this, the "overheat" signal is provided by the thermocouple which is built in the turret bearing and is sensitive to any abnormal change in the temperature, the "failing sequencer battery" signal is provided by a voltmeter, the "failing nut runner" signal is provided by a torque gauge, the "failing barrel lid" signal is provided by the micro switch 138 that detects this, and the "no workpieces" signal is provided by a micro switch that is located adjacent to the passage of the workpieces that are delivered by the workpiece delivery unit 339 and is actuated when it detects this condition. Those signals are fed to the central computer which causes the display to present the appropriate status information.

The running modes for each individual operation include the "removal" mode, the "place" mode, and the "change abrasive media" mode. These modes may be selected from the menu shown in FIG. 31(*c*), and each mode screen appears as shown in FIGS. 31(*d*), (*e*) and (*f*) when the corresponding mode is selected from the above menu display. The details for each mode are listed in FIGS. 31(*g*)-(*i*). The specific functions provided for each mode have already been described.

It will be understood from the foregoing description that the present invention provides multiple functions such as rotating barrel, centrifugal flow barrel, heavy rotating barrel, and rotating barrel under centrifugal force operations which can be performed either singly or in any combination of the selected operations. Each individual operation allows the running modes to be selected. All possible combinatons of the operations that are selected for a particular type of workpiece may be performed in sequence, and therefore the processing for the workpieces may proceed from one type of operation to another automatically as well as in a continuous manner. The sequence of the operations that best meet the requirements for the particular type of workpieces may be selected by supplying the unique code number for each type of workpiece. The effects are reduced labor and economical running.

Although the present invention has been described with reference to the several preferred embodiments thereof, it should be understood that various changes and modifications may be made without departing from the spirit and scope of the invention.

We claim:

1. A full automatic multi-function workpiece finishing machine that enables different types of operations to be performed singly or in combination of selected operations that best meet the requirements for a particular type of workpiece to be finished, said machine comprising:

a machine frame;

a main spindle across said machine frame;

a turret means rotatably supported on said main spindle;

a plurality of barrel containers each having a lid and mounted on said turret means and each having a shaft on which the corresponding barrel container is rotatably supported, each of said shafts being mounted substantially perpendicular to said main spindle;

first driving means for rotating said turret means and connected to said main spindle, said first driving means including means for controlling the speed of rotation of said turret means at any number of revolutions per minute according to a desired finishing mode;

second driving means for rotating said plurality of barrel containers and connected to the respective ones of said plurality of barrel containers, said second driving means including means for controlling the speed of rotation of said barrel containers so as to be the same as or different from the number of revolutions per minute of said main spindle;

means for handling a lid of a barrel positioned adjacent said turret means and including lid handling drive means for driving said lid handling means;

a lid cleaning unit adjacent said lid handling means and including cleaning unit drive means for driving said lid cleaning unit;

a finishing compound supply and compound/water draining unit adjacent said turret means and including unit drive means for driving said unit for supplying a finishing compound to said barrel containers and draining compound and water from said barrel containers;

separator means below said barrel containers for receiving a mixture of abrasive media and workpieces and separator drive means for driving said separator means for separating finished workpieces from abrasive media;

means for supplying batches of workpieces to be finished to said barrel containers and including drive means therefor;

abrasive media tanks;

abrasive media supply means including drive means and for selectively receiving controlled amounts of different types of abrasive media from said abrasive media tanks and delivering abrasive media to said barrel containers;

a transfer means for transferring abrasive media separated in said mass separator means to said abrasive media tanks and including transfer drive means;

a computer controlled sequence controller connected to the respective controlling means of said first and second driving means and to the respective lid cleaning unit drive means for operating said first and second driving means and said lid cleaning unit drive means separately or in respective combinations of the different types of operations thereof with a particular type of abrasive media, each single operation or combination meeting the particular requirements of a particular workpiece to be finished and each single operation or combination of the different types of operations being identified by a unique code number and previously defined and stored in the computer; and means for associating said unique code numbers with respective batches of workpieces to be finished and for identifying said unique code numbers and means for supplying said code numbers to the computer for causing said sequence controller to perform the particular operation or sequence of operations for that code number.

2. A machine as claimed in claim 1 in which said means for associating said unique code numbers comprises means for associating the code numbers with respective masses of a particular type of workpiece to be finished and a particular type of abrasive media to be used with those workpieces.

3. A machine as claimed in claim 2 in which said means for supplying batches of workpieces and said abrasive media supply means have as a common element at least one bucket for receiving an abrasive media and a batch of workpieces to be finished, and said means for associating comprises means for affixing to said bucket an indicator means for indicating a code number, and said means for identifying and supplying said code numbers comprises a reader means for reading said indicator means.

4. A machine as claimed in claim 1 in which said second driving means includes a sleeve rotatably mounted coaxially around said turret main spindle, and said turret includes first bevel gears mounted on corresponding shafts, one for each barrel container, and rotatably supported by a bearing means, said sleeve having a second bevel gear fixed to one end thereof, said second bevel gear meshing with said first bevel gears on said turret, a pulley fixed to the end of each bevel gear shaft on the opposite end from the corresponding first bevel gear, and power transmission means connecting the respective pulleys to the respective barrel shafts.

* * * * *